US008019267B2

(12) United States Patent
Katano et al.

(10) Patent No.: US 8,019,267 B2
(45) Date of Patent: Sep. 13, 2011

(54) FIXER, FIXING DEVICE, AND IMAGE FORMING APPARATUS

(75) Inventors: Yasuo Katano, Kanagawa (JP); Tsuneo Kurotori, Tokyo (JP); Tomoyasu Hirasawa, Tokyo (JP); Hiromichi Komai, Kanagawa (JP)

(73) Assignee: Ricoh Company, Ltd, Tokyo (JP)

( * ) Notice: Subject to any disclaimer, the term of this patent is extended or adjusted under 35 U.S.C. 154(b) by 457 days.

(21) Appl. No.: 12/279,663

(22) PCT Filed: Feb. 2, 2007

(86) PCT No.: PCT/JP2007/052299

§ 371 (c)(1),
(2), (4) Date: Aug. 15, 2008

(87) PCT Pub. No.: WO2007/094245

PCT Pub. Date: Aug. 23, 2007

(65) Prior Publication Data

US 2009/0067904 A1 Mar. 12, 2009

(30) Foreign Application Priority Data

Feb. 16, 2006 (JP) ..... 2006-038715

(51) Int. Cl.
*G03G 15/20* (2006.01)
*G03G 9/00* (2006.01)
*G03G 13/20* (2006.01)

(52) U.S. Cl. ..... 399/340; 399/339; 430/112; 430/124.1

(58) Field of Classification Search ..... 399/339, 399/340; 430/124.21
See application file for complete search history.

(56) References Cited

U.S. PATENT DOCUMENTS

| | | | | |
|---|---|---|---|---|
| 5,476,739 | A | 12/1995 | Takama et al. | |
| 5,822,671 | A | 10/1998 | Takama | |
| 6,947,700 | B2 | 9/2005 | Kurotori et al. | |
| 7,046,952 | B2 | 5/2006 | Kurotori et al. | |
| 2006/0115762 | A1 | 6/2006 | Katano et al. | |
| 2007/0243483 | A1 * | 10/2007 | Katano et al. | 430/124.21 |
| 2008/0063446 | A1 * | 3/2008 | Katano et al. | 399/340 |
| 2009/0003903 | A1 * | 1/2009 | Katano et al. | 399/340 |

FOREIGN PATENT DOCUMENTS

| | | |
|---|---|---|
| EP | 0 636 946 | 2/1995 |
| JP | 53 23637 | 3/1978 |
| JP | 59 119364 | 7/1984 |
| JP | 4 282311 | 10/1992 |
| JP | 5 95438 | 12/1993 |
| JP | 7-72748 | 3/1995 |
| JP | 8 262789 | 10/1996 |
| JP | 2000-221796 | 8/2000 |
| JP | 3290513 | 3/2002 |
| JP | 2004 109747 | 4/2004 |
| JP | 2004 109749 | 4/2004 |
| JP | 2004 252029 | 9/2004 |

* cited by examiner

*Primary Examiner* — David M Gray
*Assistant Examiner* — Francis Gray
(74) *Attorney, Agent, or Firm* — Oblon, Spivak, McClelland, Maier & Neustadt, L.L.P.

(57) ABSTRACT

A disclosed fixing device fixes resin particles onto a medium by applying a fixer including a softening agent onto the resin particles resting on the medium. The softening agent softens the resin particles by dissolving or causing swelling of at least part of resin included in the resin particles. A foamed fixer is generated from the fixer. The foamed fixer whose layer thickness is controlled is applied onto the resin particles resting on the medium.

20 Claims, 12 Drawing Sheets

FIXER, FIXING DEVICE, AND IMAGE FORMING APPARATUS

TECHNICAL FIELD

The present invention relates to fixers, fixing devices, and image forming apparatuses, and in particular, to a fixer, a fixing device, and an image forming apparatus for fixing particles including resin to a medium.

BACKGROUND ART

There are image forming apparatuses such as printers, fax machines, and copiers. These image forming apparatuses form images including characters and symbols based on image data, and print the images onto recording media. In particular, electrophotographic image forming apparatuses can form highly precise images on plain paper at high speed, and are therefore widely used in offices. In electrophotographic image forming apparatuses, a heat fixing method is widely used. Specifically, toner resting on a recording medium is fused with heat, and pressure is applied on the toner, so that the toner is fixed onto the recording medium. The heat fixing method is preferable in that images are fixed at high speed and with high quality.

However, more than half of the power consumed by an electrophotographic image forming apparatus is used for heating the toner in the heat fixing method. In consideration of the measures for environmental protection in recent years and continuing, there are needs for a low power consuming (energy-saving) fixing device. Specifically, there is a need for a method of considerably decreasing the temperature at which the heat is applied to the toner for fixing the toner, or a method of fixing the toner without applying heat. An ideal method for saving energy is to fix the toner onto a recording medium without heating the toner at all (non-heat fixing method).

Patent Document 1 discloses a wet-type fixing method of fixing toner, which is an example of the non-heat fixing method. An oil-in-water type fixing agent is used in this method, which is made by dispersing and mixing an organic compound in water. The organic compound is soluble and can swell but is insoluble or hardly soluble in water. First, toner is applied onto a certain position on a material without being fixed thereon (unfixed on the material onto which the toner is to be fixed); the fixing agent is sprayed or dropped on the surface of the material; the toner melts or swells; and the material is dried, so that the toner is fixed on the material.

The wet-type fixing method disclosed in Patent Document 1 uses the oil-in-water type fixing agent in which the organic compound, which is insoluble or hardly soluble in water, is dispersed and mixed in water. Thus, when a large amount of the fixing agent is applied to the unfixed toner resting on a recording medium such as transfer paper (material onto which the toner is to be fixed), the recording medium absorbs the water included in the fixing agent. As a result, the recording medium is creased or curled. This obstructs the operation of consistently conveying recording media and at high-speed, which is a property required of an image forming apparatus. One approach is to use a drying device to evaporate the large amount of water included in the fixing agent in order to remove water from the fixing agent applied to the recording medium. However, this requires the same amount of power consumed by an image forming apparatus employing the heat fixing method.

There are several types of oil fixers that do not repel water-repellent unfixed toner. Such an oil fixer is obtained by dissolving, in an oil solvent, a material that causes toner to dissolve or swell. Patent Document 2 discloses a fixer in which the material for dissolving or causing swelling of resin comprising the toner is obtained by diluting (dissolving) a component such as aliphatic dibasic acid ester with a diluent (solvent) such as a nonvolatile dimethyl silicone. Patent Document 3 discloses a fixing solvent used in a fixing method of fixing an unfixed toner image formed by an electrostatic method onto an image receiving sheet, such that an undistorted, clear image is easily obtained. The fixing solvent is capable of dissolving toner, which fixing solvent is obtained by mixing 100 pts. vol. of a solvent that is compatible with silicon oil with 8-120 pts. vol. of silicon oil. This oil fixing solvent includes an oil solvent that is highly compatible with water-repellent unfixed toner. Therefore, the oil fixing solvent is capable of dissolving or causing swelling of the toner without repelling the water-repellent unfixed toner, and fixing the toner onto a recording medium.

Patent Document 1: Japanese Patent No. 3,290,513

Patent Document 2: Japanese Laid-Open Patent Application No. 2004-109749

Patent Document 3: Japanese Laid-Open Patent Application No. S59-119364

Patent Document 4: Japanese Laid-Open Patent Application No. 2004-109747

In the technology disclosed in the above Patent Documents, liquid is applied onto a layer of unfixed toner. However, problems arise as described with reference to FIGS. 13A, 13B. An application roller 1 is used as a contact-application unit for applying a fixer onto an unfixed toner layer 3 resting on a recording medium 2. When a fixer layer 4 on the application roller 1 is thinner than the unfixed toner layer 3 as shown in FIG. 13A, at the position where the application roller 1 separates from the recording medium 2, unfixed toner particles are pulled by surface tension on the surface of the application roller 1. The surface tension is generated by a liquid film of the fixer on the application roller 1. Accordingly, the toner particles adhere to the surface of the application roller 1 (also referred to as toner offset), and the image on the recording medium 2 is considerably disturbed. Conversely, when the fixer layer 4 on the application roller 1 is thicker than the unfixed toner layer 3 as shown in FIG. 13B, at the position where the application roller 1 separates from the recording medium 2, the surface tension of the liquid film of the fixer on the surface of the application roller 1 does not affect (move) the toner particles, because the amount of the fixer is excessive. Accordingly, the toner particles do not adhere to the surface of the application roller 1. However, a large amount of the fixer is applied on the paper (the recording medium 2), which takes a long time to dry, thus degrading the responsiveness of the fixing operation. Furthermore, a considerable amount of undried liquid remains on the paper (the recording medium 2), i.e., a damp feeling remains when the paper is touched with one's hand. Accordingly, with the method of applying a fixer with a roller, it is extremely difficult to enhance fixing responsiveness and reduce the amount of undried liquid by applying an extremely small amount of fixer on the toner layer resting on the paper, and at the same time prevent toner particles from adhering to the fixing roller. Even when a die coating unit, a blade application unit, or a wire bar application unit is employed as the contact-application unit, when an extremely small amount of fixer is used, the toner particles are caused to adhere to the contact-application unit due to surface tension.

As described above, in the conventional methods of applying the fixer with the contact-application unit, it is extremely difficult to achieve two properties at the same time; i.e., to enhance fixing responsiveness by applying an extremely small amount of fixer on the toner layer resting on the paper, and to prevent toner images from being disturbed by applying the fixer in a uniform manner.

DISCLOSURE OF THE INVENTION

The present invention provides a fixer, a fixing device, and an image forming apparatus in which one or more of the above-described disadvantages are eliminated.

A preferred embodiment of the present invention provides a fixer, a fixing device, and an image forming apparatus in which the fixer is applied to resin particles such as toner resting on a medium such as paper so that the resin particles are quickly fixed on the medium after being applied with the fixer, without disturbing the resin particles, and in which the fixer can be applied in extremely small amounts such that undried liquid (oil) does not remain on the medium.

An embodiment of the present invention provides a fixing device for fixing resin particles onto a medium by applying a fixer including a softening agent onto the resin particles resting on the medium, wherein the softening agent softens the resin particles by dissolving or causing swelling of at least part of resin included in the resin particles, the fixing device including a foamed fixer generating unit configured to generate a foamed fixer from the fixer; a layer thickness controlling unit configured to control a layer thickness of the foamed fixer generated by the foamed fixer generating unit; and an applying unit configured to apply the foamed fixer whose layer thickness is controlled onto the resin particles resting on the medium.

An embodiment of the present invention provides a fixer for fixing resin particles onto a medium, the fixer including a softening agent configured to soften the resin particles by dissolving or causing swelling of at least part of the resin particles; a frothing agent; and a foam increasing agent.

According to one embodiment of the present invention, a fixing operation can be performed with excellent responsiveness using an extremely small amount of fixer, and an offset of the resin particles onto a fixer application unit can be prevented so that resin particles resting on a medium are not disturbed.

BRIEF DESCRIPTION OF THE DRAWINGS

Other objects, features and advantages of the present invention will become more apparent from the following detailed description when read in conjunction with the accompanying drawings, in which.

BEST MODE FOR CARRYING OUT THE INVENTION

Figure 1A:
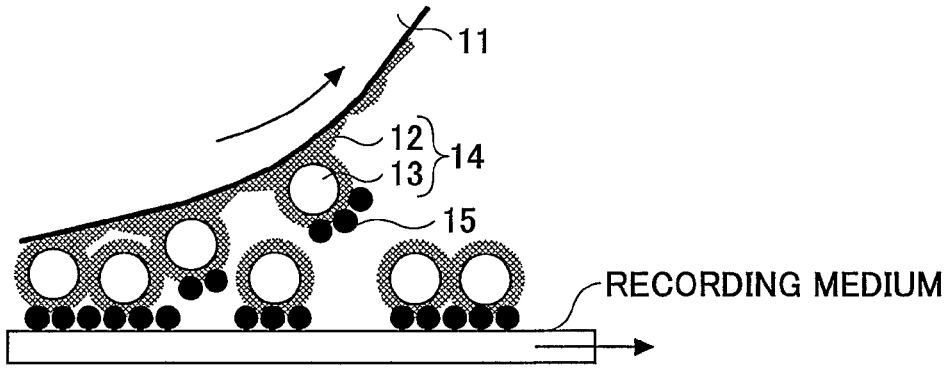
FIGS. 1A, 1B are enlarged views of a part where the surface, of an application roller contacts unfixed resin particles in a roller application unit according to an embodiment of the present invention, where high pressure is applied on a contact surface between the application roller and a recording medium.

A description is given, with reference to the accompanying drawings, of an embodiment of the present invention.

First, a description of the principle of the present invention is given below. The present invention focuses on the fact that a foam type liquid including a large amount of bubbles is extremely low in volume density. As described in the background of the invention, the fixer layer on the application roller employed as the contact-application unit needs to be thick enough so that resin particles do not adhere to the application roller (i.e., so that toner offset is prevented). This means that the volume of the fixer on the surface of the application roller needs to be large enough so that the fixer is uniformly applied and the resin particles do not adhere to the roller. However, after the fixer is applied, the amount of fixer present on the resin particle layer on the medium is preferably small, so that fixing responsiveness is enhanced and less liquid remains undried on the medium. This means that the fixer on the surface of the application roller is preferably light in weight. By making the volume density of the fixer low, it is possible to satisfy the conditions of being large in volume when being applied but light in weight after having been applied on the medium. Even when the volume is large when being applied, the actual weight can be made light. Therefore, the fixer preferably has a low volume density (weight divided by volume).

Focusing on this principle, the applicant of the present invention have disclosed in Patent Document 4 a technology of applying a foamed fixer on an intermediate transfer belt in an extremely small amount. However, the main purpose of the technology disclosed in Patent Document 4 is to reduce the amount of liquid of the fixer, not to prevent toner offset or to prevent the image from being disturbed. Furthermore, in the configuration disclosed in Patent Document 4, the foamed fixer is scattered onto an unfixed toner layer resting on the intermediate transfer member, but nothing is mentioned about directly applying the fixer onto unfixed toner resting on a medium such as paper with a contact-application unit such as a roller, or controlling the thickness of the fixer layer. Moreover, by applying the fixer in a contact manner by using, e.g., a roller, the foamed fixer including fine bubbles can be uniformly applied as a thin layer on the unfixed toner image, almost without any irregularities. Further studies were made on the method of applying with a roller a foamed fixer with bubbles, and it was found that resin particles cannot always be prevented from adhering to the surface of the roller simply by applying the formed fixer. It was found that the configuration of bubble layers in the foamed fixer on the surface of the roller and the operation of controlling the thickness of the fixer layer including the bubble layers have a significant impact in preventing resin particles from adhering to the roller (i.e., preventing toner offset).

Figure 1B:
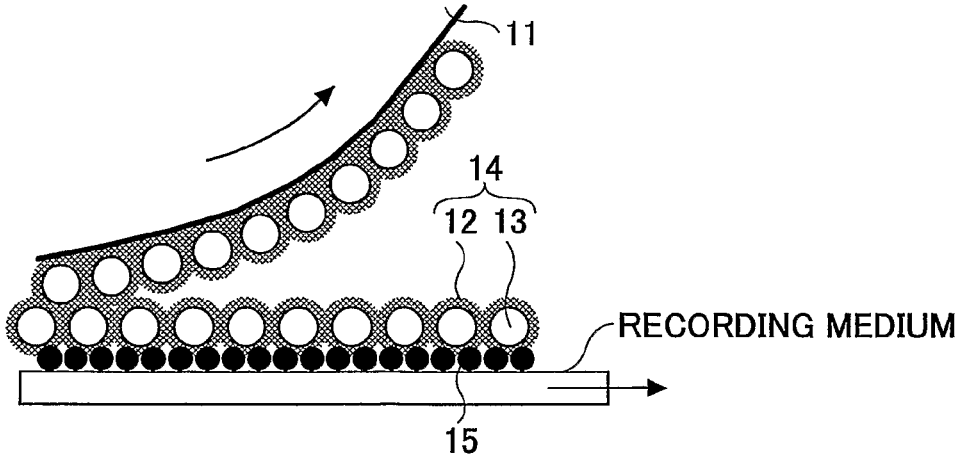
Figure 2A:
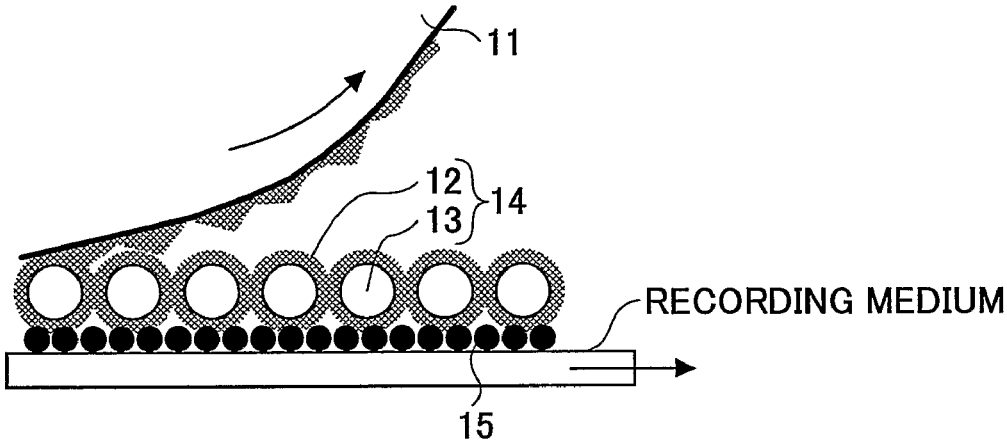
FIGS. 2A, 2B are enlarged views of a part where the surface of an application roller contacts unfixed resin particles in a roller application unit according to an embodiment of the present invention, where low pressure is applied on a contact surface between the application roller and a recording medium.
Figure 2B:
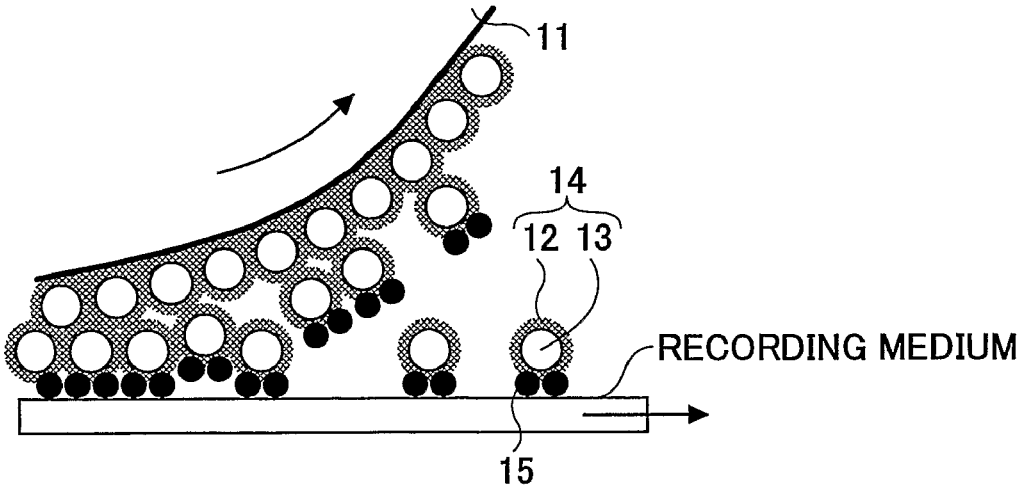

FIGS. 1A-2B are enlarged views of a part where the surface of a roller contacts unfixed resin particles in a roller application unit. FIGS. 1A, 1B illustrate cases where high pressure is applied on the contact surface between an application roller 11 and a recording medium; FIGS. 2A, 2B illustrate cases where low pressure is applied.

First, a description is given of cases where high pressure is applied on the contact surface between the application roller 11 and the recording medium. On the surface of the application roller 11, a foamed fixer 12 has a single layer of bubbles 13 in FIG. 1A, whereas the foamed fixer 12 has plural layers of the bubbles 13 in FIG. 1B. The bubbles 13 in FIGS. 1A, 1B have the same diameter. Accordingly, the layer of the foamed fixer 12 shown in FIG. 1A is thinner than that of FIG. 1B. As the foamed fixer 12 only has a single layer of the bubbles 13, the bubbles 13 tend to adhere to the surface of the application roller 11 due to surface tension. As a result, the foamed fixer 12 is not uniformly applied onto a layer of resin particles (unfixed toner particles) 15, and some of the unfixed toner particles 15 adhere to the bubbles 13 adhering to the surface of the application roller 11 (see 14). Meanwhile, when the foamed fixer 12 on the surface of the application roller 11 has plural layers of the bubbles 13 as shown in FIG. 1B, the bubbles 13 are embedded into the rough surface of the layer of unfixed toner particles 15 on the recording medium (see 14). As a result, the plural layers of bubbles 13 of the foamed fixer 12 are easily separated from each other, so that the foamed fixer 12 is uniformly applied onto the layer of the unfixed toner particles 15 as shown in FIG. 1B. Therefore, toner offset is minimized.

Thus, when high pressure is applied on the contact surface between the application roller 11 and the recording medium, the offset of the unfixed toner particles 15 onto the application roller 11 is prevented in the following manner. That is, the offset can be prevented by measuring in advance the average size of bubbles 13 to be generated, and controlling the thickness of the layer of the foamed fixer 12 on the application roller 11 so that plural layers of the bubbles 13 are formed. Therefore, it is ensured that the layer of the foamed fixer 12 formed on the application roller 11 always includes plural layers of the bubbles 13, thereby preventing the toner offset.

Next, a description is given of cases where low pressure is applied on the contact surface between the application roller 11 and the recording medium. When the foamed fixer 12 on the surface of the application roller 11 includes a single layer of the bubbles 13 as shown in FIG. 2A, the bubbles 13 easily adhere onto the rough surface of the layer of unfixed toner particles 15 (see 14). Thus, the layer of bubbles 13 is separated from the surface of the application roller 11, so that the foamed fixer 12 is applied onto the unfixed toner particles 15. When the foamed fixer 12 on the surface of the application roller 11 includes plural layers of the bubbles 13 as shown in FIG. 2B, the cohesion between the bubbles 13 is strong, and therefore, the bubbles 13 tend to remain on the application roller 11. Unlike to the case illustrated in FIG. 2A, the unfixed toner particles 15 adhere to the bubbles 13 remaining on the application roller 11 (see 14), resulting in the offset of the unfixed toner particles 15 onto the surface of the application roller 11.

Thus, when low pressure is applied on the contact surface between the application roller 11 and the recording medium, the offset of the unfixed toner particles 15 onto the application roller 11 is prevented in the following manner. That is, the offset can be prevented by measuring in advance the average size of bubbles 13 to be generated, and controlling the thickness of the layer of the foamed fixer 12 on the application roller 11 so that only a single layer of the bubbles 13 is formed therein. Therefore, the layer of the foamed fixer 12 formed on the application roller 11 is made to include a single layer of the bubbles 13, thereby preventing the toner offset, as if it were under high pressure. If the layer of the foamed fixer 12 on the application roller 11 is too thick, the layer of the foamed fixer 12 becomes fluid at the contact portion between the application roller 11 and the recording medium, and the unfixed toner particles 15 are caused to run along with the fluid, which causes an image failure (hereinafter, "fluid image"). This can be prevented by controlling the thickness of the layer of the foamed fixer 12 on the application roller 11 such that the layer of the foamed fixer 12 does not flow.

As described above, by controlling the thickness of the foamed fixer layer according to the sizes of the bubbles included in the foamed fixer and the applied pressure, it is possible to prevent the toner offset onto the contact-application unit such as the roller and to prevent a fluid image, and the fixing operation can be performed by applying an extremely small amount of fixer. An embodiment of the present invention is based on this principle.

In an embodiment of the present invention, a fixer that includes a softening agent for softening the resin particles by dissolving or causing swelling of at least a part of a resin particle is used. The fixer is applied with a contact-application unit to the resin particles resting on a medium so as to fix the resin particles onto the medium. When the fixer contacts the surfaces of the resin particles on the medium when being applied, the fixer is in a foamed status including bubbles. The thickness of the layer of the foamed fixer is controlled according to applied pressure in order to prevent toner offset onto the contact-application unit such as a roller and to prevent a fluid image. This technology is effective when the resin particles are toner particles used in electrophotography; by controlling the layer thickness of the foamed fixer according to the layer thickness of the resin particles, toner offsets and fluid images can be prevented.

Figure 3:
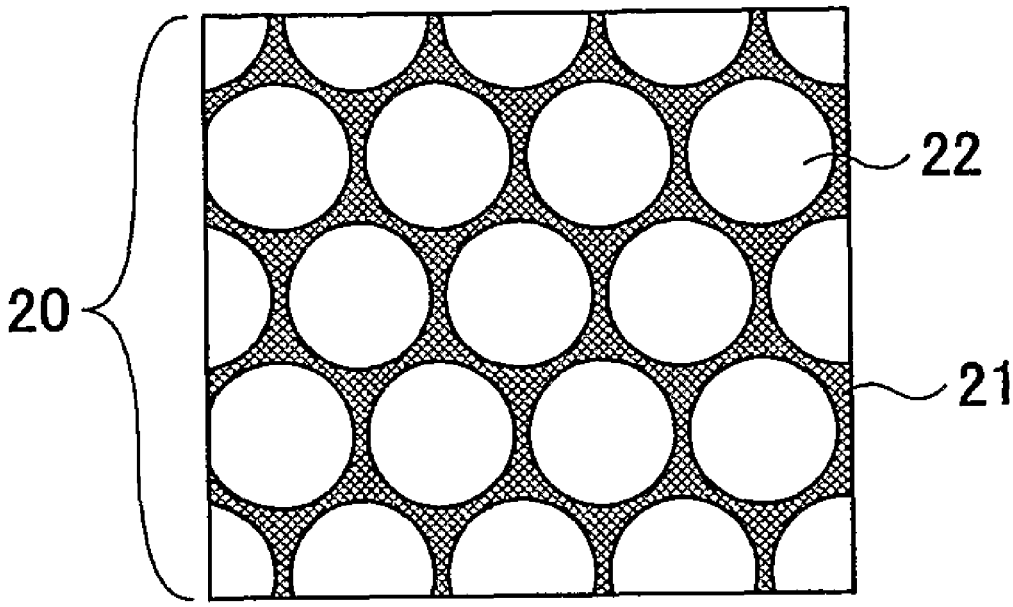
FIG. 3 is a schematic diagram of a configuration of bubble layers in a foamed fixer when the fixer is being applied.
Figure 4:
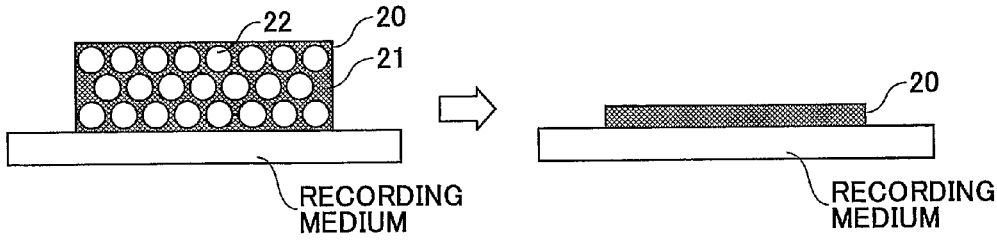
FIG. 4 illustrates how the fixer changes after application.

FIG. 3 is a schematic diagram of the configuration of bubble layers in a foamed fixer 20 when the fixer is being applied. A liquid 21 includes a softening agent, and bubbles 22 are included in the liquid 21. By including a large amount of bubbles 22, the fixer 20 can have an extremely low volume density. Accordingly, as shown in FIG. 4, the fixer 20 can be large in volume when first applied onto the recording medium. However, as the fixer 20 has a low volume density and the applied fixer 20 is light in weight, once the bubbles break down, the actual amount of the fixer 20 becomes extremely small. A "foamed status" mentioned in an embodiment of the present invention refers to a status where bubbles are dispersed in a liquid and the liquid is compressible.

Figure 5:
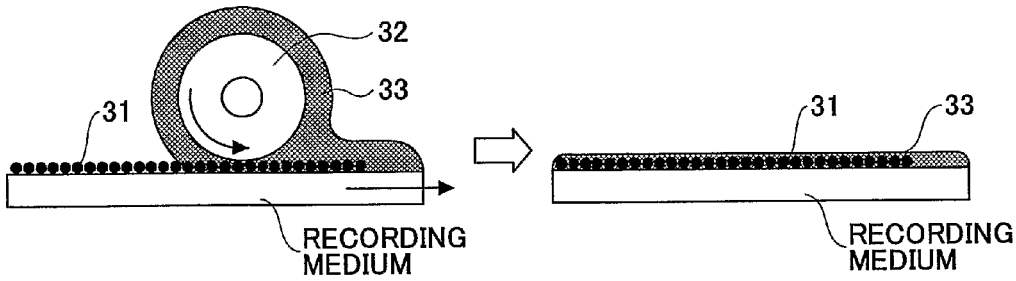
FIG. 5 is a schematic diagram illustrating how foamed fixer is applied with a fixer application unit according to an embodiment of the present invention.

Next, a fixer application unit according to an embodiment of the present invention is described. The fixer application unit employed in an embodiment of the present invention is a contact-application unit. FIG. 5 is a schematic diagram illustrating how the foamed fixer is applied with the fixer application unit, i.e., an application roller, according to an embodiment of the present invention. Resin particles 31 shown in FIG. 5 are toner particles. A layer of a foamed fixer 33 is formed on the surface of an application roller 32. The thickness of the layer of the foamed fixer 33 is optimized according to the sizes of bubbles in the foamed fixer 33, the applied pressure, and the thickness of the layer of unfixed toner particles (resin particles) 31, so that the resin particles 31 do not offset onto the application roller 32. Even when a thick layer of the foamed fixer 33 is applied to the layer of the resin particles 31 resting on the recording medium, the actual amount of the liquid including the softening agent applied on the layer of the resin particles 31 is extremely small. Specifically, bubble stability is maintained for a predetermined time, and after the passage of the predetermined time, the bubbles break down. Because the volume density of the foamed fixer 33 is extremely low, the actual amount of the foamed fixer 33 applied is extremely small.

The number of bubbles included in the foamed fixer varies according to the volume density and the thickness of the fixer layer. Generally, the volume density is preferably 0.01 $g/cm^3$-0.1 $g/cm^3$. The foamed fixer including layers of bubbles refers to a foamed fixer including a single layer or plural layers of bubbles, and the layers do not necessarily need to have clear-cut layer surfaces. Furthermore, as long as the fixer is in a foamed status when applied onto a layer of resin particles such as toner on a recording medium such as paper, the fixer does not need to be in a foamed status inside a storage container. Therefore, when stored inside the storage container, the fixer can be a liquid without bubbles; a unit for turning the liquid into a foamed status is preferably provided when discharging the liquid from the container or in a liquid conveying path between the container and the layer of resin particles. The container can be made compact if the fixer is stored as a liquid inside the container, and the liquid is turned into the foamed status after being discharged from the container.

A description is given of methods of turning the liquid fixer into a foamed status including bubbles after being discharged from an airtight container.

Figure 6A:
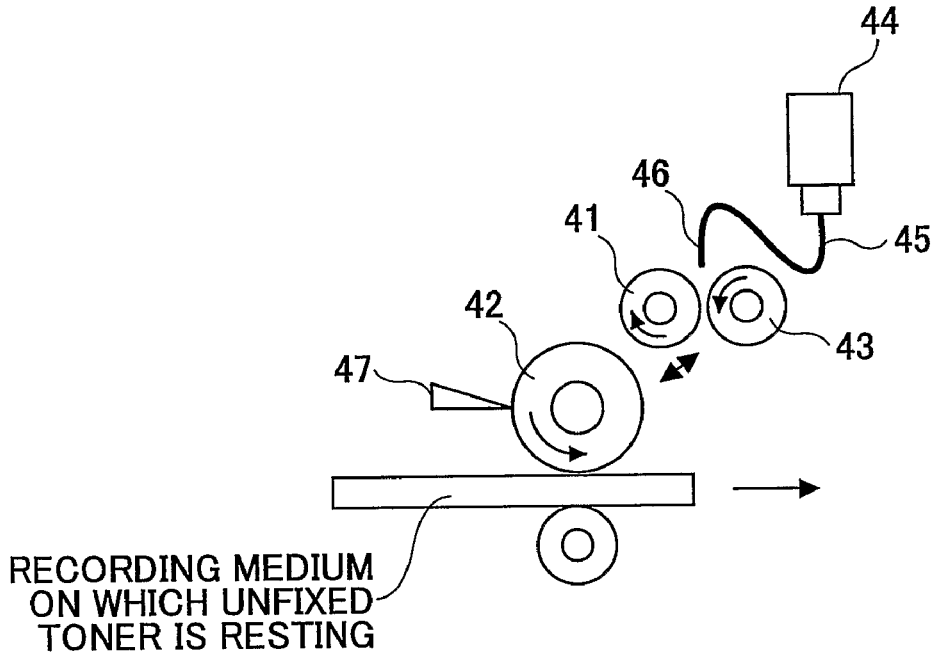
FIGS. 6A, 6B are schematic diagrams of an example of a fixer application unit and a foamed fixer layer thickness control unit according to an embodiment of the present invention.
Figure 6B:
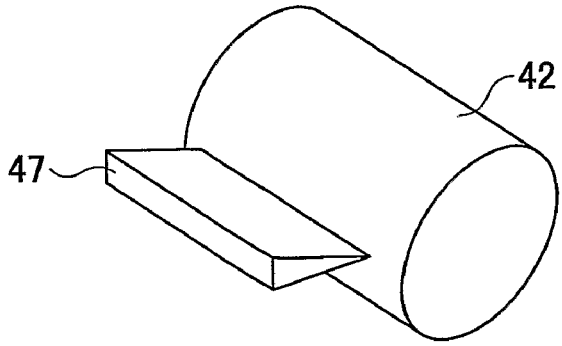

A first method is to discharge a liquid fixer including a softening agent from an airtight container, and then applying a shearing force to the liquid fixer with a bubble generating unit, so that a large amount of bubbles is generated in the fixer. FIGS. 6A, 6B illustrate an example of a stirring roller used as a unit for applying a shearing force. As shown in FIG. 6A, a foamed fixer supplying roller 41 is separated from an application roller 42 at first. A liquid fixer from a fixer airtight container 44 for storing the fixer is discharged from a liquid supplying outlet 46 via a liquid conveying pipe 45. The liquid fixer is caused to stay at the nip part between the foamed fixer supplying roller 41 and a stirring roller 43. The stirring roller 43 is rotated to stir the liquid fixer and turn it into a foamed status. Subsequently, the foamed fixer supplying roller 41 comes in contact with the application roller 42 to supply the foamed fixer onto the application roller 42. As shown in FIGS. 6A, 6B, a blade 47 is provided to optimize the thickness of the fixer layer on the surface of the application roller 42 according to the size of the bubbles in the fixer and applied pressure.

A second method is described with reference to FIG. 7. Liquefied gas or compressed gas is put in an airtight container 51 together with a liquid fixer including a softening agent. When the fixer is ejected from an actuator 52 and a nozzle 53 attached to the airtight container 51, the liquefied gas or the compressed gas expands so that a large number of bubbles are included in the liquid, thereby creating the foamed fixer. The foamed fixer is discharged from a liquid supplying outlet 54 via a liquid conveying pipe, and is supplied to a nip part between an application roller 55 and a blade 56 in contact with the application roller 55. The thickness of the layer of the foamed fixer on the application roller 55 is controlled by adjusting the gap between the blade 56 and the application roller 55, thereby optimizing the thickness of the layer of the foamed fixer according to the sizes of the bubbles included in the fixer and the applied pressure.

Figure 8A:
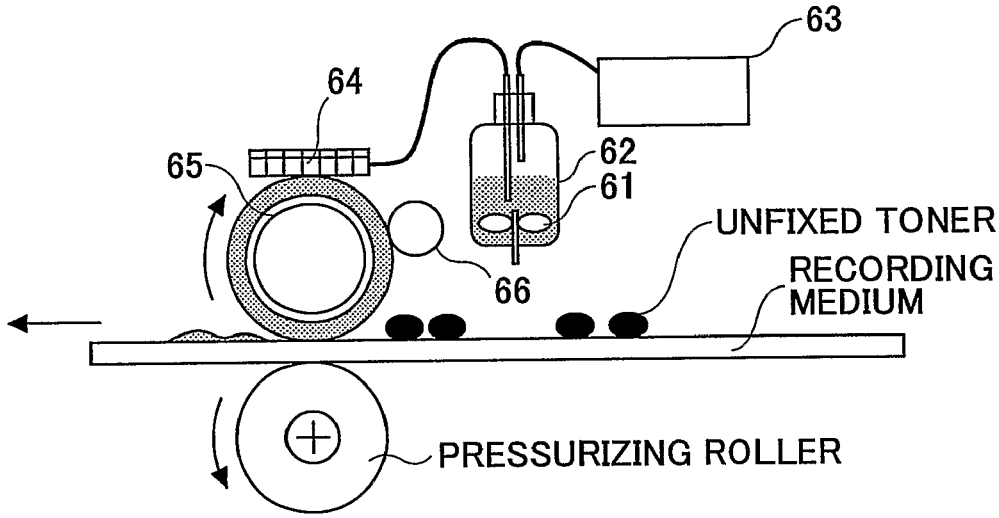
FIGS. 8A, 8B are schematic diagrams of yet another example of the fixer application unit and the foamed fixer layer thickness control unit according to an embodiment of the present invention.
Figure 8B:
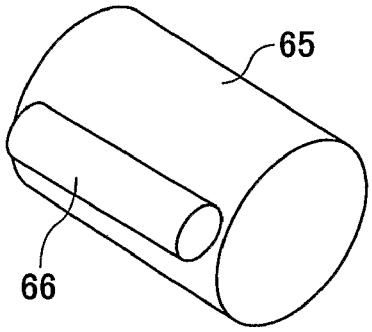

A third method is described with reference to FIGS. 8A, 8B. Stirring wings 61 apply a shearing force by stirring the liquid fixer including the softening agent inside an airtight container 62, thereby forming a foamed fixer. High-pressure air is sent out from a compressed-gas cylinder 63 to discharge the foamed fixer from the airtight container 62. The foamed fixer is supplied onto the surface of an application roller 65 by a fixer replenishing pad 64. As shown in FIGS. 8A, 8B, a wire bar 66 controls the thickness of the foamed fixer on the application roller 65, thereby optimizing the thickness of the layer of the foamed fixer according to the sizes of the bubbles included in the fixer and the applied pressure. After being stored for a long time in the airtight container 62, the bubbles break down and the fixer returns to a liquid status. However, the liquid fixer can be stirred again to be turned into a foamed fixer immediately before usage.

A fourth method is described with reference to FIG. 9. Instead of using the application roller as shown in FIG. 7, the fourth method employs an application belt 71 to apply the fixer on unfixed toner resting on a recording medium. When the fixer is ejected from the actuator 52 and the nozzle 53 attached to the airtight container 51, the liquefied gas or the compressed gas expands so that a large number of bubbles are included in the liquid, thereby creating the foamed fixer. The foamed fixer is discharged from the liquid supplying outlet 54 via the liquid conveying pipe, and is supplied to a nip part between the application belt 71 and the blade 56 in contact with the application belt 71. The thickness of the layer of the foamed fixer on the application belt 71 is controlled by adjusting the gap between the blade 56 and the application belt 71, thereby optimizing the thickness of the layer of the foamed fixer according to the sizes of the bubbles included in the fixer and the applied pressure. The application belt 71 can be configured with a member obtained by coating a base such as a seamless nickel belt or a seamless PET file with a releasing fluororesin such as PFA. The application unit such as a roller or a belt preferably moves in the same direction as that of the layer of resin particles, at the contact surface with the resin particles.

A method and unit for controlling the thickness of the foamed fixer on the contact member surface are described below. The optimum layer thickness is determined based on the average particle size of bubbles formed by the unit for creating the foamed fixer, the applied pressure at the contact part between the application unit and the medium, and the viscosity of the liquid of the fixer. When a rotating member such as a roller is employed as the application unit, a preferable method of controlling the layer thickness to be within the determined appropriate range is to scrape off the excess foamed fixer with a device provided with a certain gap between the surface of the application unit and the device. For example, the blade 47 shown in FIGS. 6A, 6B or the wire bar 66 shown in FIGS. 8A, 8B are preferable units for scraping off (controlling) the fixer. In FIGS. 6A, 6B, the blade 47 is to be spaced apart from the surface of the application roller 42 by a gap that is approximately equal to the appropriate thickness range. In FIGS. 8A, 8B, the diameter of the wire bar 66 is to be approximately equal to the appropriate thickness range.

Figure 10A:
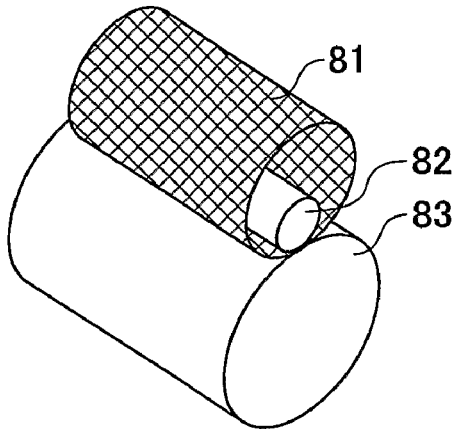
FIGS. 10A, 10B are schematic diagrams of yet another example of the fixer application unit and the foamed fixer layer thickness control unit according to an embodiment of the present invention.
Figure 10B:
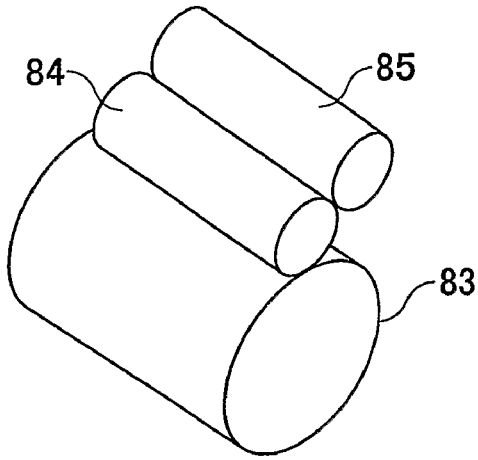

Another method and unit for controlling the thickness is to apply the foamed fixer on the surface of the rotating member such as a roller such that the fixer layer has an appropriate thickness. Referring to FIG. 10A, a foamed fixer is held inside a cylindrical stencil member 81. A press roller 82 pushes out the foamed fixer from the cylindrical stencil member 81 to be supplied onto an application member 83. Sizes of meshed openings of the cylindrical stencil member 81 are determined so that a fixer layer having an appropriate thickness is formed. Referring to FIG. 10B, groove-rollers 84, 85 are used to supply the fixer. A groove of the groove rollers 84, 85 is determined so that a fixer layer having an appropriate thickness is formed. Other than the roller application unit, examples of the contact-application unit for applying the foamed fixer include a direct stencil application unit, a gravure roller application unit, a rotating wire bar application unit, and so forth. These application units have rough surfaces with meshes or streaks, and control the application amount so as to control the layer thickness of the foamed fixer where the surface of the application unit contacts the medium.

Next, a description is given of the liquid prescription of the fixer. As described above, the foamed fixer is a liquid including a softening agent and one or more layers of bubbles. A frothing agent and a foam increasing agent are preferably included so that the bubble stability is maintained and the bubble sizes are uniform. Furthermore, a thickening agent is preferably included to increase the viscosity such that the bubbles are stably dispersed in the liquid. A surface active agent such as higher fatty acid alkali soap is preferably used as the frothing agent; appropriate examples are sodium stearate, sodium palmitate, and sodium myristate. A fatty acid alkanolamide type nonionic surface active agent is preferably used as the foam increasing agent; preferable examples are coconut fatty acid diethanolamide, coconut fatty acid monoethanolamide, and isopropanolamide laurate.

Furthermore, in order to prevent the offset, the foamed fixer layer is preferably thicker than the resin particle layer at the application part. Moreover, the bubbles are preferably larger than the resin particles so that they easily adhere to the resin particles. When the resin particles are toner particles employed in a dry type electrophotographic method, the toner particles are about 4 μm-10 μm and an unfixed toner layer resting on a paper medium is about 10 μm-30 μm. Therefore, the sizes of the bubbles in the liquid including a softening agent are preferably 20 μm-100 μm.

The liquid of the fixer can consist primarily of a softening agent, without additives such as the frothing agent or the foam increasing agent. However, if the amount of the softening agent in the fixer is too large, the resin may become excessively soft and adhesive. Therefore, the fixer preferably includes a diluent solvent to dilute the softening agent. The diluent solvent can be oil-based or water-based. The dilution configuration can be a configuration in which the softening agent is dissolved in the diluent solvent, or an O/W emulsion configuration in which the softening agent is oil-based and the diluent solvent is water-based, or a W/O emulsion configuration in which the softening agent is water-based and the diluent solvent is oil-based, or an O/O emulsion configuration in which the softening agent is oil-based and the diluent solvent is oil-based.

When the fixer is stored in a high-pressure airtight container, the liquefied gas or the compressed gas is preferably dissolved or dispersed in the liquid including the softening agent. Appropriate examples of the liquefied gas are fatty acid hydrocarbons such as propane, butane, pentane, hexane, and dimethyl ether. Appropriate examples of the compressed gas are nitrogen gas and argon gas.

The softening agent, which softens the resin by dissolving or causing swelling of the resin, includes aliphatic ester. Aliphatic ester has excellent dissolving/swelling properties for dissolving or causing swelling of at least part of the resin included in toner.

In consideration of safety for the human body, the softening agent preferably has an acute oral toxicity (LD50) of greater than or equal to 3 g/kg, more preferably 5 g/kg. As shown by the fact that aliphatic ester is widely used as materials for cosmetics, it is highly safe for the human body.

An apparatus in which the operation of fixing toner on a recording medium is performed is often located in an enclosed space. Even after the toner is fixed to the recording medium, the softening agent remains in the toner. Accordingly, the toner is preferably fixed on the recording medium without generating volatile organic compounds (VOC) or an unpleasant odor. This means that the softening agent preferably does not include a substance that generates volatile organic compounds (VOC) or an unpleasant odor. Aliphatic ester has a high boiling point, low volatility, and does not generate an irritating odor compared to general-purpose organic solvents such as toluene, xylene, methyl ethyl ketone, and ethyl acetate. Furthermore, aliphatic ester is advantageous in that it does not cause water pollution.

An example of a practical scale used for measuring odor with high precision in an office environment is an order index obtained by a three-point comparison type smell bag method, which is an organoleptic measuring method (10×log (dilute strength of a substance until the odor of the substance cannot be perceived)). The odor index of aliphatic ester included in the softening agent is preferably less than or equal to 10. When the odor index is less than or equal to 10, an unpleasant odor cannot be perceived under normal conditions in an office environment. Furthermore, not only the softening agent but also the other agents included in the fixer preferably do not emit an unpleasant odor or an irritating odor.

The aliphatic ester included in the fixer according to an embodiment of the present invention preferably includes saturated aliphatic ester. When the aliphatic ester includes saturated aliphatic ester, it is capable of enhancing storage stability of the softening agent (resistance to oxidization and hydrolysis). Furthermore, saturated aliphatic ester is highly safe for the human body, and many types of saturated aliphatic ester can dissolve or cause swelling of resin included in toner within one second. Moreover, saturated aliphatic ester reduces the adhesiveness of toner provided on a recording medium. This is possibly because saturated aliphatic ester forms an oil film on the surface of a toner particle that has been dissolved or caused to swell.

The saturated aliphatic ester included in the fixer according to an embodiment of the present invention includes compounds indicated in the general formula

R1COOR2 where R1 is an alkyl group having a carbon number of 11 or more and 14 or less, and R2 is a straight-chain or a branched chain alkyl group having a carbon number of 1 or more and 6 or less.

When the saturated aliphatic ester includes compounds indicated in the general formula R1COOR2, where R1 is an alkyl group having a carbon number of 11 or more and 14 or less, and R2 is a straight-chain or a branched chain alkyl group having a carbon number of 1 or more and 6 or less, properties of dissolving or causing swelling of the resin included in the toner are improved. The odor indices of these compounds are less than or equal to 10, which means that these compounds do not have an unpleasant odor or an irritating odor.

Examples of the above compound aliphatic monocarboxylic acid ester are ethyl laurate, hexyl laurate, tridecylic acid ethyl, tridecylic acid isopropyl, myristic acid ester, and isopropyl myristate. Most of these aliphatic monocarboxylic acid esters dissolve in an oil-based solvent but do not dissolve in water. Accordingly, in an oil-based solvent, the aliphatic monocarboxylic acid ester is dissolved. In a water-based solvent, an oil phase is formed by the aliphatic monocarboxylic acid ester, and a water phase primarily including water is also formed. The oil phase and the water phase form a fixer that is a W/O emulsion or an O/W emulsion.

The aliphatic ester in the fixer according to an embodiment of the present invention preferably includes aliphatic dicarboxylic acid ester. When the aliphatic ester includes aliphatic dicarboxylic acid ester, the resin included in the toner can be dissolved or caused to swell within a shorter amount of time. For example, when printing is performed at a high speed of approximately 60 ppm, toner is preferably fixed to a recording medium within one second from when the fixer is applied to unfixed toner resting on the recording medium. When the aliphatic ester includes aliphatic dicarboxylic acid ester, and toner is fixed to a recording medium within 0.1 second from when the fixer is applied to unfixed toner resting on the recording medium. Furthermore, the resin included in the toner can be dissolved or caused to swell even with a smaller amount of softening agent added to the fixer, and therefore, it is possible to reduce the amount of softening agent included in the fixer.

The aliphatic dicarboxylic acid ester included in the fixer according to an embodiment of the present invention includes compounds indicated in the general formula $$R3(COOR4)_2$$

where R3 is an alkylene group having a carbon number of 3 or more and 8 or less, and R4 is a straight-chain or a branched chain alkyl group having a carbon number of 2 or more and 5 or less.

When the aliphatic dicarboxylic acid ester includes compounds indicated in the general formula $R3(COOR4)_2$, where R3 is an alkylene group having a carbon number of 3 or more and 8 or less, and R4 is a straight-chain or a branched chain alkyl group having a carbon number of 2 or more and 5 or less, properties of dissolving or causing swelling of the resin included in the toner are improved. The odor indices of these compounds are less than or equal to 10, which means that these compounds do not have an unpleasant odor or an irritating odor.

Examples of the above compound aliphatic dicarboxylic acid ester are succinate ethylhexyl, dibutyl adipate, diisobutyl adipate, diisopropyl adipate, di-isodecyl adipate, diethyl sebacate, and dibutyl sebacate. Most of these aliphatic dicarboxylic acid esters dissolve in an oil-based solvent but do not dissolve in water. Accordingly, in an oil-based solvent, the aliphatic dicarboxylic acid ester is dissolved. In a water-based solvent, an oil phase is formed by the aliphatic dicarboxylic acid ester, and a water phase primarily including water is also formed. The oil phase and the water phase form a fixer that is a W/O emulsion or an O/W emulsion.

The aliphatic ester in the fixer according to an embodiment of the present invention preferably includes aliphatic dicarboxylic acid dialkoxyalkyl. When the aliphatic ester includes aliphatic dicarboxylic acid dialkoxyalkyl, properties of fixing toner onto a recording medium are improved.

The aliphatic dicarboxylic acid dialkoxyalkyl included in the fixer according to an embodiment of the present invention includes compounds indicated in the general formula $$R5(COOR6\text{-}O\text{—}R7)_2$$

where R5 is an alkylene group having a carbon number of 2 or more and 8 or less, R6 is an alkylene group having a carbon number of 2 or more and 4 or less, and R7 is an alkyl group having a carbon number of 1 or more and 4 or less.

When the aliphatic dicarboxylic acid dialkoxyalkyl includes compounds indicated in the general formula $R5(COOR6\text{-}O\text{—}R7)_2$, where R5 is an alkylene group having a carbon number of 2 or more and 8 or less, R6 is an alkylene group having a carbon number of 2 or more and 4 or less, and R7 is an alkyl group having a carbon number of 1 or more or 14 or less, properties of dissolving or causing swelling of the resin included in the toner are improved. The odor indices of these compounds are less than or equal to 10, which means that these compounds do not have an unpleasant odor or an irritating odor.

Examples of the above compound aliphatic dicarboxylic acid dialkoxyalkyl are succinate diethoxyethy, succinate dibutoxyethyl, diethoxyethy adipate, dibutoxyethyl adipate, and diethoxyethy sebacate. The aliphatic dicarboxylic acid dialkoxyalkyl is dissolved or dispersed in an oil-based solvent. In the oil-based solvent, an oil phase is formed by the aliphatic dicarboxylic acid dialkoxyalkyl, and a water phase primarily including water is also formed. The oil phase and the water phase form a fixer that is a W/O emulsion or an O/W emulsion. The fixer can be formed by dissolving the aliphatic dicarboxylic acid dialkoxyalkyl in a water-based water phase.

The object of fixing, i.e. particles including resin, is not limited to toner; any kind of particles including resin can be employed. For example, resin particles including a conductive material can be employed. The material of the recording medium is not limited to paper; metal, resin, ceramics, etc., can be employed. The shape of the recording medium is not limited to a sheet; a two-dimensional shape with planar and curved surfaces can be employed.

The fixing effect of the fixer according to an embodiment of the present invention is most significant when applied to toner employed in electrophotographic processes, among the examples of particles including resin. Toner includes a coloring material, a charge controlling agent, and resins such as a binding resin and a release agent. The resin included in toner is not particularly limited. Preferable examples of binding resins are polystyrene resin, a styrene-acrylonitrile copolymer resin, and a polyester resin. Preferable examples of release agents are wax components such as polyethylene. Other than the binding resin, the toner can include a conventionally known coloring agent, an electric charge controlling agent, a fluidity imparting agent, an external additive, etc. The toner is preferably made water-repellent by fixing hydrophobic particles having a methyl group such as hydrophobic silica and hydrophobic titanium oxide onto the surfaces of the toner particles. The recording medium is not particularly limited; examples are paper, cloth, and a plastic film such as an OHP transparency including a liquid permeable layer. "Oil-base" mentioned in an embodiment of the present invention refers to a property where the solubility in water under room temperature (20° C.) is 0.1 weight % or less.

The oil-based solvent and the softening agent preferably have a sufficient level of compatibility with respect to the toner particles that are made water-repellent. Compatibility refers to the level of extended wettability of a liquid with respect to the surface of a solid when the liquid contacts the solid. That is, the oil-based solvent and the softening agent preferably exhibit a sufficient level of wettability with respect to the water-repellent toner particles. The surface of the water-repellent toner particle provided with hydrophobic particles such as hydrophobic silica and hydrophobic titanium oxide is covered with the methyl group included in the hydrophobic silica and hydrophobic titanium oxide, and thus has surface energy of approximately 20 mN/m. In reality, the surface of the water-repellent toner particle is not totally covered with hydrophobic particles, and therefore, the surface energy of the water-repellent toner is estimated as being approximately 20 mN/m-30 mN/m. Accordingly, in order to be compatible with the water-repellent toner (have sufficient wettability), the surface tension of the diluent solvent and the softening agent is preferably 20 mN/m-30 mN/m. Examples of oil-based diluent solvents are a fluorinated oil, a paraffinic solvent, an olefinic solvent, and a silicon solvent. Among these, a solvent including olefinic compounds has a low viscosity and yet is nonvolatile, and is thus advantageous in that the viscosity can be adjusted by adding a thickening agent. Among silicon solvents, dimethyl silicone has extremely low surface tension, and is most compatible with toner. The oil-based solvent and the softening agent according to an embodiment of the present invention are preferably nonvolatile. "Nonvolatile" mentioned in an embodiment of the present invention refers to a condition where the boiling point is 260° C. or higher at atmospheric pressure. If the boiling point is 260° C. or higher, the fixer does not become volatile even when stored in a simple, low-cost container; therefore, fixing properties are not degraded and the inside of an image forming apparatus provided with a fixing device is not contaminated. If the boiling point is lower than 260° C., the storage container and the liquid conveying path between the container and the fixing device need to be made airtight, thus increasing the cost of the device.

Furthermore, by using a water-based solvent as the diluent solvent, a highly safe, environmentally-benign fixer can be formed. When a water-based solvent is used, the surface tension is preferably made to be 20 mN/m-30 mN/m by adding a surface active agent. The water-based solvent preferably includes monohydric or polyhydric alcohol. These materials enhance the stability of bubbles in the foamed fixer, so that the bubbles do not break down easily. For example, a monohydric alcohol such as cetanol and polyhydric alcohol such as glycerin, propylene glycol, or 1,3-butylene glycol, are preferable.

Preferable examples of a dispersing agent used for forming an O/W emulsion or a W/O emulsion with the softening agent and the diluent solvent are sorbitan fatty acid esters such as sorbitan monooleate, sorbitan monostearate, and sorbitan sesquioleate, and sucrose esters such as sucrose laurate and sucrose stearate.

Examples of methods of dispersing the softening agent in the diluent solvent are mechanically mixing them with rotating wings such as a homomixer or a homogenizer, and oscillating them with an ultrasonic homogenizer. In any case, a strong shearing force is applied to the softening agent in the diluent solvent to disperse the softening agent.

In the fixer according to an embodiment of the present invention, the oil-based solvent that forms an oil phase in the fixer that is a W/O emulsion or an O/W emulsion or an O/O emulsion preferably includes dimethyl silicone. When the oil-based solvent includes dimethyl silicone, the fixer is highly compatible with the water-repellent toner, and is therefore capable of considerably wetting the water-repellent toner. Dimethyl silicone is a silicon solvent that has low surface tension of approximately 20 mN/m, and is thus highly compatible with the water-repellent toner. Accordingly, when the fixer according to an embodiment of the present invention is applied to the water-repellent toner, image failures caused by the water-repellent toner can be reduced. Furthermore, dimethyl silicone is odorless and highly safe for the human body. Therefore, an odorless fixer that is highly safe for the human body can be formed by using dimethyl silicone as the oil-based solvent. For example, dimethyl silicone that has a viscosity of 20 mPa/second or more has low volatility. When this dimethyl silicone is included in the fixer as the oil-based solvent, and liquid droplets of this fixer are applied to a layer of water-repellent toner, failures hardly occur in the toner layer. When the fixer includes dimethyl silicone as the diluent solvent, preferable examples of a dispersing agent used for forming an O/O emulsion or a W/O emulsion as the fixer are polyether degeneration silicone and polyol degeneration silicone.

The fixing device for fixing toner can have a pair of smoothing rollers (hard rollers). The smoothing rollers apply pressure onto the toner after the fixer according to an embodiment of the present invention is applied on the toner, and the toner is dissolved or caused to swell by an agent (softening agent) that dissolves or causes swelling of at least part of the resin included in the toner. By applying pressure onto the dissolved or swollen toner with the pair of smoothing rollers (hard rollers), the surface of the layer of the dissolved or swollen toner is smoothened, thus giving luster to the toner. Furthermore, the pair of rollers can press the dissolved or swollen toner into the recording medium so that the toner can be more securely fixed on the recording medium.

An image forming apparatus according to an embodiment of another invention can form an image on a recording medium with toner including resin by employing an image forming method according to the above-described embodiments of the present invention. Therefore, the image forming apparatus according to an embodiment of this other invention provides an image forming method and an image forming apparatus capable of efficiently fixing toner onto a recording medium.

Figure 11A:
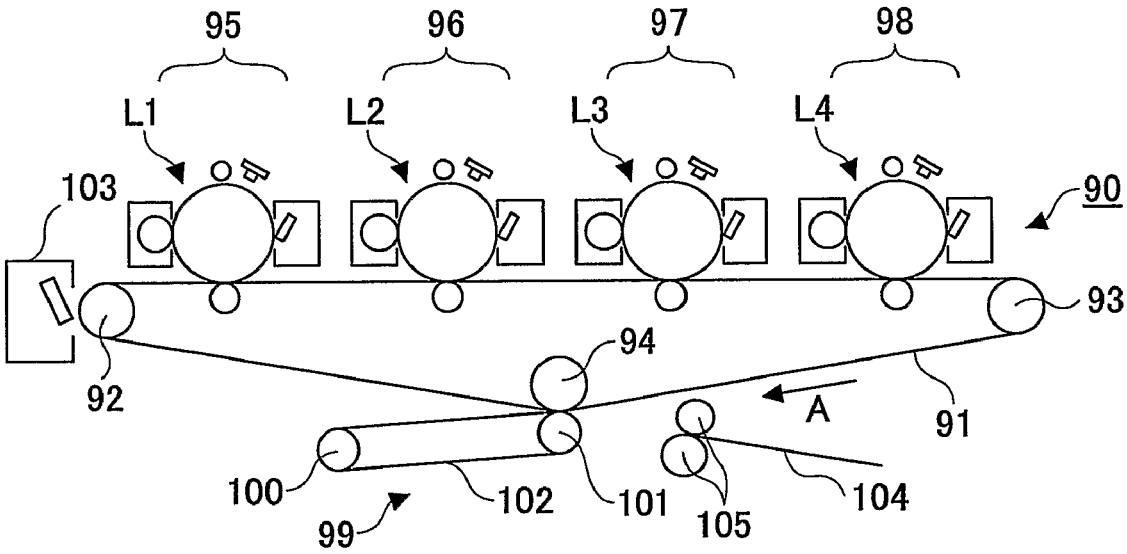
FIGS. 11A, 11B are schematic diagrams of an image forming apparatus according to an embodiment of another invention.
Figure 11B:
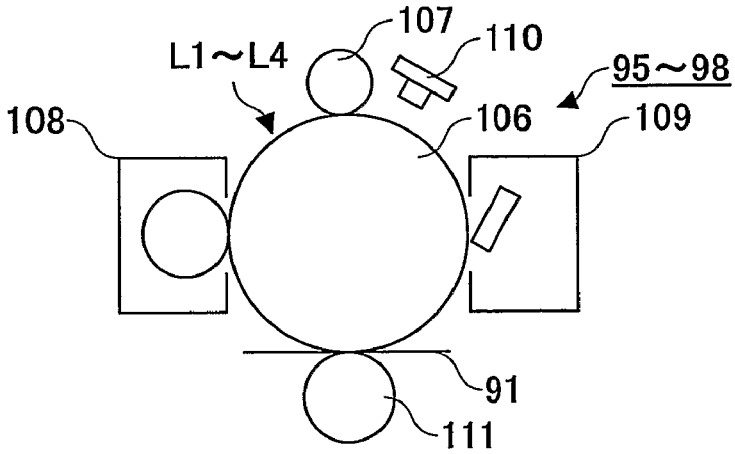

FIGS. 11A, 11B are schematic diagrams of the image forming apparatus according to an embodiment of another invention. The image forming apparatus shown in FIGS. 11A, 11B can be, for example, a copier or a printer. FIG. 11A is an overall diagram a color electrophotographic tandem type image forming apparatus, and FIG. 11B is a schematic diagram of one of the image forming units included in the image forming apparatus shown in FIG. 11A. The image forming apparatus 90 shown in FIGS. 11A, 11B includes an intermediate transfer belt 91 as a toner image carrier. The intermediate transfer belt 91 is stretched around three support rollers 92-94, and rotates in a direction indicated by an arrow A. Image forming units 95-98 corresponding to black, yellow, magenta, and cyan are provided on the intermediate transfer belt 91. Above these image forming units, there is provided a not shown exposing device. For example, if the image forming apparatus 90 is a copier, a scanner scans image information of an original. According to the image information, the exposing device irradiates exposure light beams L1-L4 to write electrostatic latent images onto corresponding photoconductive drums in the image forming units. A secondary transfer device 99 is arranged at a position facing the support roller 94 across the intermediate transfer belt 91. The secondary transfer device 99 includes a secondary transfer belt 102 stretched around two support rollers 100, 101. Instead of the transfer belt, a transfer roller can be used in the secondary transfer device 99. A belt cleaning device 103 is arranged at a position facing the support roller 92 across the intermediate transfer belt 91. The belt cleaning device 103 removes residual toner remaining on the intermediate transfer belt 91.

A recording sheet 104 serving as a recording medium is guided to a secondary transfer part by a pair of paper feeding rollers 105. At the secondary transfer part, a toner image is transferred from the intermediate transfer belt 91 onto the recording sheet 104 by pressing the secondary transfer belt 102 against the intermediate transfer belt 91. The recording sheet 104 with the toner image transferred (but not yet fixed) thereon is conveyed by the secondary transfer belt 102 to a fixing device for fixing toner according to an embodiment of the present invention. The fixing device controls the thickness of a layer of the foamed fixer based on the image information received from the not shown exposing device. The unfixed toner image transferred onto the recording sheet 104 is fixed onto the recording sheet 104 by the fixing device. That is, the fixing device controls the thickness of a layer of the foamed fixer based on the image information such as a color image or a black solid image received from the not shown exposing device, and applies the layer of the foamed fixer on the unfixed toner image transferred onto the recording sheet 104. An agent (softening agent) included in the foamed fixer according to an embodiment of the present invention dissolves or causes swelling of at least part of the resin included in the toner, thereby fixing the unfixed toner image onto the recording sheet 104.

Next, the image forming unit is described. As shown in FIG. 11B, in each of the image forming units 95-98, a charging device 107, a developing device 108, a cleaning device 109, and a charge neutralizer 110 are arranged around a photoconductive drum 106. A primary transfer device 111 is provided at a position facing the photoconductive drum 106 across the intermediate transfer belt 91. The charging device 107 performs a contact charging method with a charging roller. The charging device 107 causes the charging roller to contact the photoconductive drum 106 to apply a voltage to the photoconductive drum 106 and uniformly charge the surface of the photoconductive drum 106. The charging device 107 can also employ a noncontact charging method with a noncontact scorotron. The developing device 108 causes toner included in a developer to adhere to an electrostatic latent image on the photoconductive drum 106, to make the electrostatic latent image become visible. The toner of each color includes a resin material of the corresponding color. This resin material is dissolved or caused to swell by the fixer according to an embodiment of the present invention. The developing device 108 includes a not shown stirring unit and a not shown developing unit. The developer not used for the developing operation is returned to the stirring unit to be reused. A toner density sensor detects the density of the toner in the developer stored in the stirring unit, so that the toner density is maintained at a fixed value. Furthermore, the primary transfer device 111 transfers the visible toner image from the photoconductive drum 106 onto the intermediate transfer belt 91. A transfer roller serving as the primary transfer device 111 is pressed against the photoconductive drum 106 with the intermediate transfer belt 91 sandwiched therebetween. The primary transfer device 111 can be a conductive brush or a noncontact corona charger, etc. The cleaning device 109 removes residual toner from the photoconductive drum 106. The cleaning device 109 can be a blade whose tip is pressed against the photoconductive drum 106. The toner collected by the cleaning device 109 is returned to the developing device 108 with a not shown collecting screw or a not shown toner recycling device to be reused. The charge neutralizer 110 is configured with a lamp that irradiates light to neutralize the electrical potential on the surface of the photoconductive drum 106.

Next, practical examples of the fixer according to an embodiment of the present invention are described.

Example 1

Prescription of Fixer

| Liquid including softening agent | |
|---|---|
| Diluent solvent: Ion exchanged water | 59 wt % |
| Softening agent: Succinate diethoxyethy (CRODA DES manufactured by CRODA Japan KK) | 5 wt % |
| Penetrating agent: Polyether degeneration silicone (Dow Corning silicone SS2802 manufactured by Toray Industries, Inc.) | 1 wt % |
| Thickening agent: Propylene glycol | 30 wt % |
| Foam increasing agent: Coconut fatty acid diethanolamide | 2 wt % |
| Frothing agent: Sodium alkylsulfate | 2 wt % |
| pH adjustor: Triethanolamine | 1 wt % |

Components in the above ratio were mixed together and stirred to form a solvent.

| Ingredients put in high-pressure airtight container | |
|---|---|
| Liquid including softening agent | 95 wt % |
| Liquefied gas (LPG) | 5 wt % |

Components in the above ratio were mixed in an airtight container and stirred to form an O/W emulsion. An airtight container with an actuator and a nozzle for releasing the contents to the atmosphere was used.

<Application Device>

Figure 7:
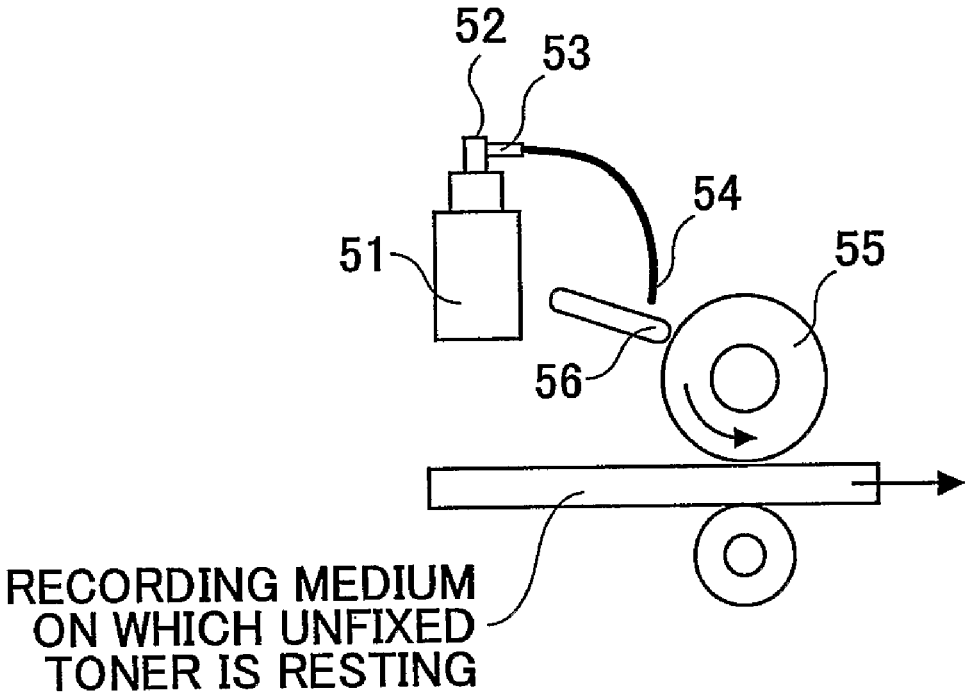
FIG. 7 is a schematic diagram of another example of the fixer application unit and the foamed fixer layer thickness control unit according to an embodiment of the present invention.

An application device having a configuration as shown in FIG. 7 was used. Specifically, the foamed fixer was discharged from the airtight container and provided on a blade. The gap between the blade and the application roller was 75 μm in one case and 150 μm in another.

Pressurizing roller: roller made of aluminum (Ø 30)

Application roller: PFA resin coating baked onto roller, manufactured by SUS corporation (Ø 30)

Blade: sheet manufactured by SUS corporation

Paper conveyance speed: 150 mm/s

Weight between pressurizing roller and application roller: 196 N on one side

The foamed fixer ejected from the high-pressure airtight container was supplied through a tube into the gap between the blade and the application roller. The volume density of the foamed fixer was 0.06 g/cm$^3$.

Figure 12A:
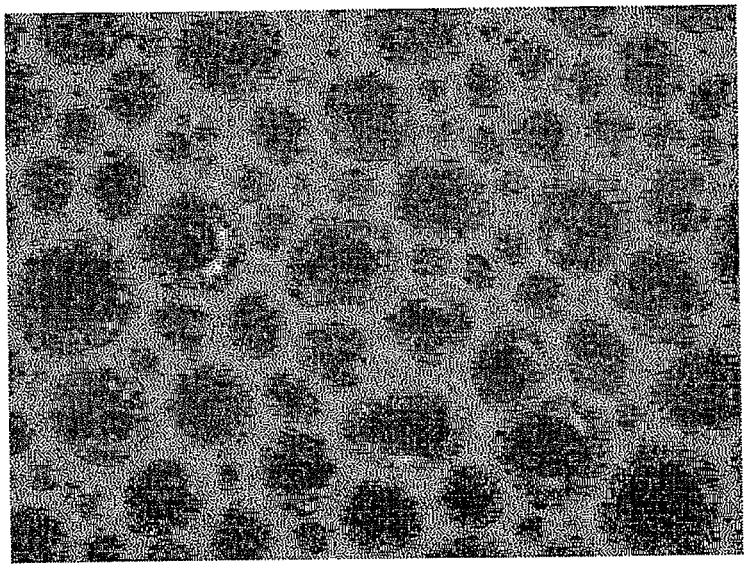
FIGS. 12A, 12B are schematic diagrams of bubbles in a foamed fixer observed with a microscope.
Figure 12B:
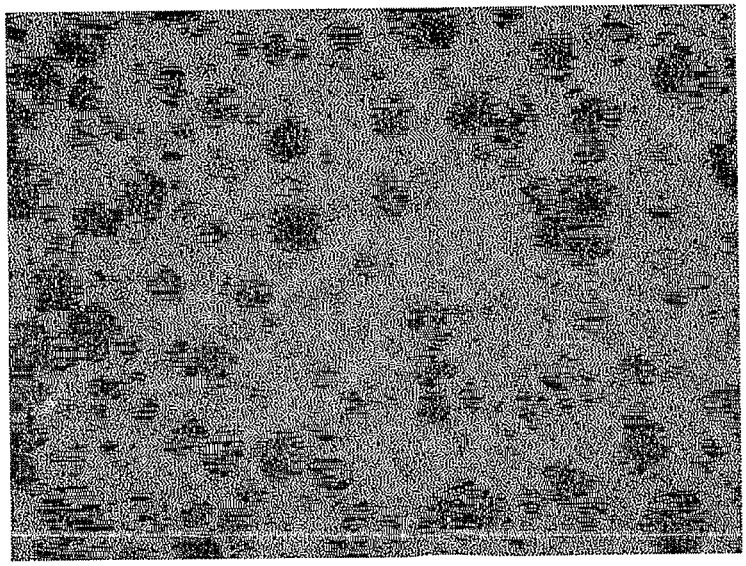
Figure 13A:
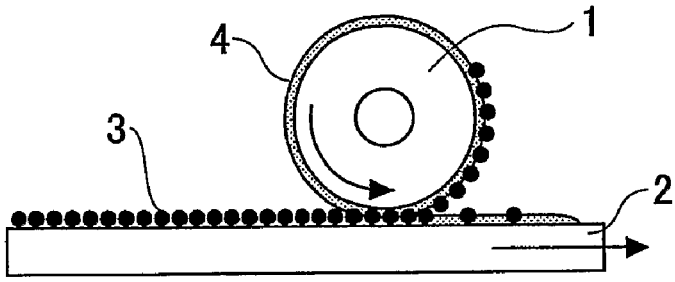
FIGS. 13A, 13B illustrate fixing operations performed by a conventional fixing device.
Figure 13B:
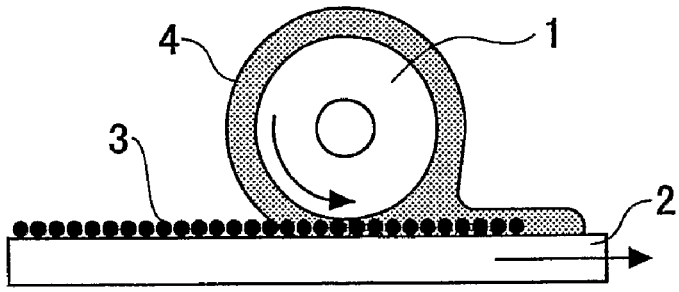

When the layer thickness of the foamed fixer was controlled with a gap of 75 μm between the blade and the application roller, a layer of the foamed fixer having a thickness of approximately 100 μm was formed on the application roller. As shown in FIG. 12A, it was observed with an optical microscope that the bubble sizes in the fixer were in a range of 30 μm-100 μm; most bubble sizes were around 70 μm. A single layer of bubbles was formed on the surface of the application roller. When the layer thickness of the foamed fixer was controlled with a gap of 150 μm between the blade and the application roller, a layer of the foamed fixer having a thickness of approximately 200 μm was formed on the application roller. As shown in FIG. 12B, it was observed with an optical microscope that the bubble sizes in the fixer were in a range of 30 μm-100 μm; most bubble sizes were around 70 μm. Plural layers of bubbles were formed on the surface of the application roller.

Ipsio Color CX8800 (manufactured by Ricoh) was employed as the printer. First, an unfixed toner color image was formed on a PPC sheet. Next, a fixing device as illustrated in FIG. 7 was used to apply the fixer with the roller, and 10 seconds later, the surface of the image was rubbed with a rag. The degree by which the toner had been fixed onto the PPC sheet was determined depending on whether the toner adhered to the rag.

When the layer thickness of the foamed fixer was made to be 100 μm with the gap of 75 μm between the blade and the application roller, i.e., when the foamed fixer included a single layer of bubbles, it was found that toner did not adhere to the rag after rubbing the image 10 seconds after applying the fixer. Furthermore, substantially no dampness remained on the PPC sheet, and substantially no curls appeared in the PPC sheet. Moreover, substantially no toner was offset onto the application roller. Meanwhile, when the layer thickness of the foamed fixer was made to be 200 μm with the gap of 150 μm between the blade and the application roller, i.e., when the foamed fixer included plural layers of bubbles, it was found that a large proportion of the toner layer was offset onto the application roller, and the image was considerably degraded. Accordingly, it was confirmed that the toner can be fixed without being offset and with excellent fixing responsiveness by controlling the layer of the foamed fixer on the application roller to have an appropriate thickness.

Example 2

Prescription of Fixer

| Liquid including softening agent | |
|---|---|
| Diluent solvent: Ion exchanged water | 59 wt % |
| Softening agent: Succinate diethoxyethy (CRODA DES manufactured by CRODA Japan KK) | 5 wt % |
| Penetrating agent: Polyether degeneration silicone (Dow Corning silicone SS2802 manufactured by Toray Industries, Inc.) | 1 wt % |
| Thickening agent: Propylene glycol | 30 wt % |
| Foam increasing agent: Coconut fatty acid diethanolamide | 2 wt % |
| Frothing agent: Sodium alkylsulfate | 2 wt % |
| pH adjustor: Triethanolamine | 1 wt % |

Components in the above ratio were mixed together and stirred to form a solvent.

| Ingredients put in high-pressure airtight container | |
|---|---|
| Liquid including softening agent | 95 wt % |
| Liquefied gas (LPG) | 5 wt % |

Components in the above ratio were mixed in an airtight container and stirred to form an O/W emulsion.

<Application Device>

An application device having a configuration as shown in FIG. 7 was used. Specifically, the foamed fixer was discharged from the airtight container and provided on a blade. The gap between the blade and the application roller was 100 μm in one case and 250 μm in another.

Pressurizing roller: roller made of aluminum (Ø 30)

Application roller: PFA resin coating baked onto roller, manufactured by SUS corporation (Ø 30)

Blade: sheet manufactured by SUS corporation

Paper conveyance speed: 150 mm/s

Weight between pressurizing roller and application roller: 196 N on one side

The fixer was supplied through a tube to a stirring roller. The fixer was sufficiently stirred by the stirring roller so that a foamed fixer was formed. The foamed fixer was applied to the application roller. The volume density of the foamed fixer was 0.1 g/cm$^3$. The average bubble size was approximately 80 μm. When the layer thickness of the foamed fixer was controlled with a gap of 100 μm between the blade and the application roller, a layer of the foamed fixer having a thickness of approximately 130 μm was formed on the application roller. When the layer thickness of the foamed fixer was controlled with a gap of 250 μm between the blade and the application roller, a layer of the foamed fixer having a thickness of approximately 300 μm was formed on the application roller.

Ipsio Color CX8800 (manufactured by Ricoh) was employed as the printer. First, an unfixed toner color image was formed on a PPC sheet. Next, a fixing device as illustrated in FIG. 7 was used to apply the fixer with the roller, and 10 seconds later, the surface of the image was rubbed with a rag. The degree by which the toner had been fixed onto the PPC sheet was determined depending on whether the toner adhered to the rag.

When the layer thickness of the foamed fixer was made to be 130 μm with the gap of 100 μm between the blade and the application roller, it was found that toner did not adhere to the rag after rubbing the image 10 seconds after applying the fixer. Furthermore, substantially no dampness remained on the PPC sheet, and substantially no curls appeared in the PPC sheet. Moreover, substantially no toner was offset onto the application roller. Meanwhile, when the layer thickness of the foamed fixer was made to be 300 μm with the gap of 250 μm between the blade and the application roller, it was found that the toner became fluid, thus creating a considerably degraded fluid image.

Example 3

Prescription of Fixer

| Liquid including softening agent | |
|---|---|
| Diluent solvent: Ion exchanged water | 59 wt % |
| Softening agent: Succinate diethoxyethy (CRODA DES manufactured by CRODA Japan KK) | 5 wt % |
| Penetrating agent: Polyether degeneration silicone (Dow Corning silicone SS2802 manufactured by Toray Industries, Inc.) | 1 wt % |
| Thickening agent: Propylene glycol | 30 wt % |
| Foam increasing agent: Coconut fatty acid diethanolamide | 2 wt % |
| Frothing agent: Sodium alkylsulfate | 2 wt % |
| pH adjustor: Triethanolamine | 1 wt % |

Components in the above ratio were mixed together and stirred to form a solvent.

<Application Device>

An application device having a configuration as shown in FIGS. 6A, 6B was used. Specifically, the fixer was discharged from the airtight container to a liquid stirring roller. The liquid stirring roller stirred the fixer and turned it into a foamed fixer. The gap between the blade and the application roller was 50 μm in one case and 100 μm in another.

Pressurizing roller: roller made of aluminum (Ø 30)

Application roller: PFA resin coating baked onto roller, manufactured by SUS corporation (Ø 30)

Foamed fixer supplying roller and stirring roller: rollers made of aluminum covered with propylene resin (Ø 20)

Paper conveyance speed: 150 mm/s

Weight between pressurizing roller and application roller: 490 N on one side

The fixer was supplied through a tube to the stirring roller. The fixer was sufficiently stirred so that a foamed fixer was formed. The foamed fixer was applied to the application roller. The volume density of the foamed fixer was 0.1 g/cm$^3$. The average bubble size was approximately 100 μm. When the layer thickness of the foamed fixer was controlled with a gap of 100 μm between the blade and the application roller, a layer of the foamed fixer having a thickness of approximately 130 μm was formed on the application roller. When the layer thickness of the foamed fixer was controlled with a gap of 50 μm between the blade and the application roller, a layer of the foamed fixer having a thickness of approximately 70 μm was formed on the application roller.

Ipsio Color CX8800 (manufactured by Ricoh) was employed as the printer. First, an unfixed toner color image was formed on a PPC sheet. Next, a fixing device as illustrated in FIGS. 6A, 6B was used to apply the fixer with the roller, and 10 seconds later, the surface of the image was rubbed with a rag. The degree by which the toner had been fixed onto the PPC sheet was determined depending on whether the toner adhered to the rag.

When the layer thickness of the foamed fixer was made to be 130 μm with the gap of 100 μm between the blade and the application roller, it was found that toner did not adhere to the rag after rubbing the image 10 seconds after applying the fixer. Furthermore, substantially no dampness remained on the PPC sheet, and substantially no curls appeared in the PPC sheet. Moreover, substantially no toner was offset onto the application roller. Meanwhile, when the layer thickness of the foamed fixer was made to be 70 μm with the gap of 50 μm between the blade and the application roller, it was found that the toner was offset onto the application roller, and the image was considerably degraded.

Example 4

Prescription of Fixer

| Liquid including softening agent | |
|---|---|
| Diluent solvent: Ion exchanged water | 59 wt % |
| Softening agent: Succinate diethoxyethy (CRODA DES manufactured by CRODA Japan KK) | 5 wt % |
| Penetrating agent: Polyether degeneration silicone (Dow Corning silicone SS2802 manufactured by Toray Industries, Inc.) | 1 wt % |
| Thickening agent: Propylene glycol | 30 wt % |
| Foam increasing agent: Coconut fatty acid diethanolamide | 2 wt % |
| Frothing agent: Sodium alkylsulfate | 2 wt % |
| pH adjustor: Triethanolamine | 1 wt % |

Components in the above ratio were mixed together and stirred to form a solvent.

<Application Device>

An application device having a configuration as shown in FIGS. 8A, 8B was used. Specifically, stirring wings provided inside the airtight container stirred the fixer by applying a shearing force to the fixer, so that a foamed fixer was formed. Compressed air was sent out from the compressed-gas cylinder to supply the fixer onto the fixer replenishing pad via the supplying pipe. The diameter of the wire bar was 0.2 mm in one case and 0.3 mm in another.

Pressurizing roller: roller made of aluminum (Ø 30)

Application roller: PFA resin coating baked onto roller, manufactured by SUS corporation (Ø 30)

Weight between pressurizing roller and application roller: 490 N on one side

Paper conveyance speed: 150 mm/s

Rotational speed of stirring wings: 3,000 rpm

The volume density of the foamed fixer was 0.03 g/cm$^3$. The bubble size was 60 μm. When the wire bar having a diameter of 0.2 mm was made to contact the application roller to scrape off the fixer, a layer of the foamed fixer having a thickness of approximately 100 μm was formed on the application roller. When the wire bar having a diameter of 0.3 mm was made to contact the application roller to scrape off the fixer, a layer of the foamed fixer having a thickness of approximately 300 μm was formed on the application roller.

Ipsio Color CX8800 (manufactured by Ricoh) was employed as the printer. First, an unfixed toner color image was formed on a PPC sheet. Next, a fixing device as illustrated in FIGS. 8A, 8B was used to apply the fixer with the roller, and 10 seconds later, the surface of the image was rubbed with a rag. The degree by which the toner had been fixed onto the PPC sheet was determined depending on whether the toner adhered to the rag.

When the layer thickness of the foamed fixer was made to be 100 μm, it was found that toner did not adhere to the rag after rubbing the image 10 seconds after applying the fixer. Furthermore, substantially no dampness remained on the PPC sheet, and substantially no curls appeared in the PPC sheet. Moreover, substantially no toner was offset onto the application roller. Meanwhile, when the layer thickness of the foamed fixer was made to be 300 μm, it was found that the toner became fluid, thus creating a considerably degraded fluid image.

Example 5

Prescription of Fixer

| Liquid including softening agent | |
|---|---|
| Diluent solvent: Ion exchanged water | 59 wt % |
| Softening agent: Succinate diethoxyethy (CRODA DES manufactured by CRODA Japan KK) | 5 wt % |
| Penetrating agent: Polyether degeneration silicone (Dow Corning silicone SS2802 manufactured by Toray Industries, Inc.) | 1 wt % |
| Thickening agent: Propylene glycol | 30 wt % |
| Foam increasing agent: Coconut fatty acid diethanolamide | 2 wt % |
| Frothing agent: Sodium alkylsulfate | 2 wt % |
| pH adjustor: Triethanolamine | 1 wt % |

Components in the above ratio were mixed together and stirred to form a solvent.

| Ingredients put in high-pressure airtight container | |
|---|---|
| Liquid including softening agent | 95 wt % |
| Liquefied gas (LPG) | 5 wt % |

Components in the above ratio were mixed in an airtight container and stirred to form an O/O emulsion.

<Application Device>

Figure 9:
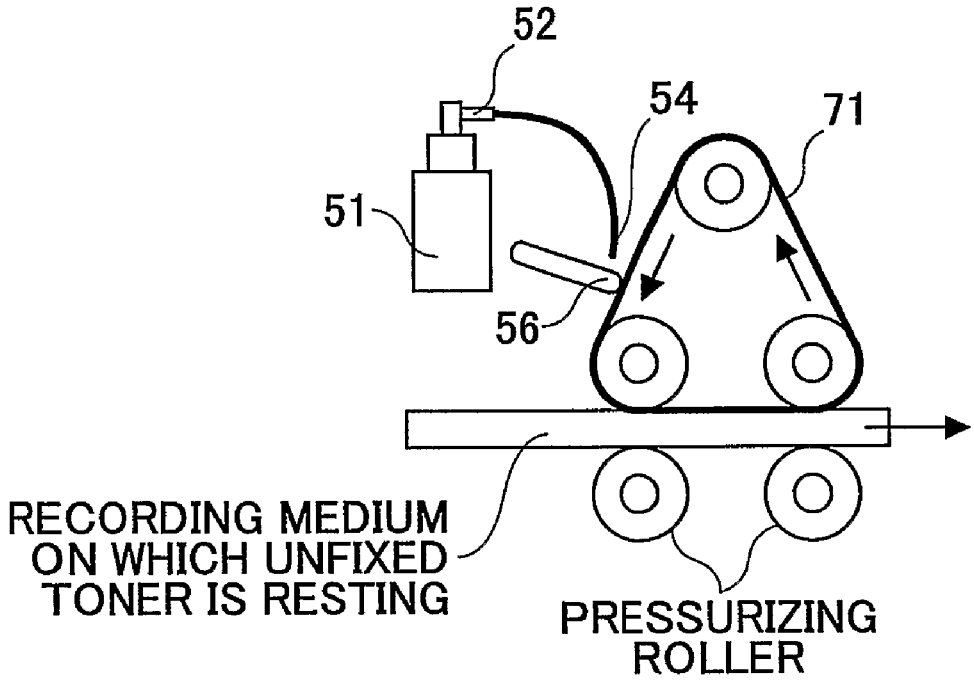
FIG. 9 is a schematic diagram of yet another example of the fixer application unit and the foamed fixer layer thickness control unit according to an embodiment of the present invention.

An application device having a configuration as shown in FIG. 9 was used. Specifically, the foamed fixer was applied to a layer of unfixed toner with the application belt. The gap between the blade and the application belt was 75 μm in one case and 150 μm in another.

Pressurizing roller: roller made of aluminum (Ø 30)

Application belt: PFA resin coating baked onto seamless film made of nickel and having a thickness of 100 μm Weight between pressurizing roller and application roller: 196 N on one side Belt nip width of application belt: 10 mm Paper conveyance speed: 300 mm/s When the layer thickness of the foamed fixer was controlled with a gap of 75 μm between the blade and the application belt, a layer of the foamed fixer having a thickness of approximately 100 μm was formed on the application belt. The bubble sizes in the foamed fixer were in a range of 30 μm-100 μm; most bubble sizes were around 70 μm. A single layer of bubbles was formed on the surface of the application belt. When the layer thickness of the foamed fixer was controlled with a gap of 150 μm between the blade and the application belt, a layer of the foamed fixer having a thickness of approximately 200 μm was formed on the application belt. The bubble sizes in the foamed fixer were in a range of 30 μm-100 μm; most bubble sizes were around 70 μm. Plural layers of bubbles were formed on the surface of the application belt.

Ipsio Color CX8800 (manufactured by Ricoh) was employed as the printer. First, an unfixed toner color image was formed on a PPC sheet. Next, a fixing device as illustrated in FIG. 9 was used to apply the fixer with the roller, and 10 seconds later, the surface of the image was rubbed with a rag. The degree by which the toner had been fixed onto the PPC sheet was determined depending on whether the toner adhered to the rag.

When the layer thickness of the foamed fixer was made to be 100 μm, it was found that toner did not adhere to the rag after rubbing the image 10 seconds after applying the fixer. Furthermore, substantially no dampness remained on the PPC sheet, and substantially no curls appeared in the PPC sheet. Moreover, substantially no toner was offset onto the application roller. Meanwhile, when the layer thickness of the foamed fixer was made to be 200 μm, it was found that a large portion of the toner layer was offset onto the application roller, and the image was considerably degraded. Accordingly, it was confirmed that the toner can be fixed without being offset and with excellent fixing responsiveness by controlling the layer of the foamed fixer on the application belt to have an appropriate thickness. Furthermore, a belt was employed as the application member with the application surface having a wide nip width. Therefore, the fixer was applied at twice the speed of applying with a roller, and without causing offset.

Example 6

Prescription of Fixer

| Liquid including softening agent | |
|---|---|
| Diluent solvent: Ion exchanged water | 53 wt % |
| Softening agent: diisobutyl adipate (KEK-DiBA manufactured by Kokyu Alcohol Kogyo Co., Ltd.) | 5 wt % |
| Penetrating agent: Polyether degeneration silicone (Dow Corning silicone SS2802 manufactured by Toray Industries, Inc.) | 2 wt % |
| Dispersing agent: POE sorbitan monostearate (REODORU TW-S120V manufactured by Kao Chemical Company) | 5 wt % |
| Thickening agent: Propylene glycol | 30 wt % |
| Foam increasing agent: Coconut fatty acid diethanolamide | 2 wt % |
| Frothing agent: Isostearyl octyld decanoate | 2 wt % |
| pH adjustor: Triethanolamine | 1 wt % |

Components in the above ratio were mixed together and stirred with an ultrasonic homogenizer to form an O/W emulsion dispersion.

| Ingredients put in high-pressure airtight container | |
|---|---|
| Liquid including softening agent | 95 wt % |
| Liquefied gas (LPG) | 5 wt % |

Components in the above ratio were mixed in an airtight container and stirred by being oscillated to form an O/W emulsion.

<Application Device>

An application device having a configuration as shown in FIG. 7 was used. Specifically, the foamed fixer was discharged from the airtight container and provided on a blade. The gap between the blade and the application roller was 75 μm in one case and 150 μm in another.

Pressurizing roller: roller made of aluminum (Ø 30)

Application roller: PFA resin coating baked onto roller, manufactured by SUS corporation (Ø 30)

Blade: sheet manufactured by SUS corporation

Paper conveyance speed: 150 mm/s

Weight between pressurizing roller and application roller: 196 N on one side

The foamed fixer ejected from the high-pressure airtight container was supplied through a tube in the gap between the blade and the application roller. The volume density of the foamed fixer was 0.06 g/cm$^3$.

When the layer thickness of the foamed fixer was controlled with a gap of 75 μm between the blade and the application roller, a layer of the foamed fixer having a thickness of approximately 100 μm was formed on the application roller. As shown in FIG. 12A, it was observed with an optical microscope that the bubble sizes in the fixer were in a range of 30 μm-100 μm; most bubble sizes were around 70 μm. A single layer of bubbles was formed on the surface of the application roller. When the layer thickness of the foamed fixer was controlled with a gap of 150 μm between the blade and the application roller, a layer of the foamed fixer having a thickness of approximately 200 μm was formed on the application roller. As shown in FIG. 12B, it was observed with an optical microscope that the bubble sizes in the fixer were in a range of 30 μm-100 μm; most bubble sizes were around 70 μm. Plural layers of bubbles were formed on the surface of the application roller.

Ipsio Color CX8800 (manufactured by Ricoh) was employed as the printer. First, an unfixed toner color image was formed on a PPC sheet. Next, a fixing device as illustrated in FIG. 7 was used to apply the fixer with the roller, and 10 seconds later, the surface of the image was rubbed with a rag. The degree by which the toner had been fixed onto the PPC sheet was determined depending on whether the toner adhered to the rag.

When the layer thickness of the foamed fixer was made to be 100 μm with the gap of 75 μm between the blade and the application roller, i.e., when the foamed fixer included a single layer of bubbles, it was found that toner did not adhere to the rag after rubbing the image 10 seconds after applying the fixer. Furthermore, substantially no dampness remained on the PPC sheet, and substantially no curls appeared in the PPC sheet. Moreover, substantially no toner was offset onto the application roller. Meanwhile, when the layer thickness of the foamed fixer was made to be 200 μm with the gap of 150 μm between the blade and the application roller, i.e., when the foamed fixer included plural layers of bubbles, it was found that a large proportion of the toner layer was offset onto the application roller, and the image was considerably degraded. Accordingly, it was confirmed that the toner can be fixed without being offset and with excellent fixing responsiveness by controlling the layer of the foamed fixer on the application roller to have an appropriate thickness.

Example 7

Prescription of Fixer

| Liquid including softening agent | |
|---|---|
| Diluent solvent: Ion exchanged water | 53 wt % |
| Softening agent: diisobutyl adipate (KEK-DiBA manufactured by Kokyu Alcohol Kogyo Co., Ltd.) | 5 wt % |
| Penetrating agent: Polyether degeneration silicone (Dow Corning silicone SS2802 manufactured by Toray Industries, Inc.) | 2 wt % |
| Dispersing agent: POE sorbitan monostearate (REODORU TW-S120V manufactured by Kao Chemical Company) | 5 wt % |
| Thickening agent: Propylene glycol | 30 wt % |
| Foam increasing agent: Coconut fatty acid diethanolamide | 2 wt % |
| Frothing agent: Isostearyl octyld decanoate | 2 wt % |
| pH adjustor: Triethanolamine | 1 wt % |

Components in the above ratio were mixed together and stirred with an ultrasonic homogenizer to form an O/W emulsion dispersion.

| Ingredients put in high-pressure airtight container | |
|---|---|
| Liquid including softening agent | 95 wt % |
| Liquefied gas (LPG) | 5 wt % |

Components in the above ratio were mixed in an airtight container and stirred by being oscillated to form an O/W emulsion.

<Application Device>

An application device having a configuration as shown in FIG. 7 was used. Specifically, the foamed fixer was discharged from the airtight container and provided on a blade. The gap between the blade and the application roller was 100 μm in one case and 250 μm in another.

Pressurizing roller: roller made of aluminum (Ø 30)

Application roller: PFA resin coating baked onto roller, manufactured by SUS corporation (Ø 30)

Blade: sheet manufactured by SUS corporation

Paper conveyance speed: 150 mm/s

Weight between pressurizing roller and application roller: 196 N on one side

The fixer was supplied through a tube to a stirring roller. The fixer was sufficiently stirred by the stirring roller so that a foamed fixer was formed. The foamed fixer was applied to the application roller. The volume density of the foamed fixer was 0.1 g/cm$^3$. The average bubble size was approximately 80 μm. When the layer thickness of the foamed fixer was controlled with a gap of 100 μm between the blade and the application roller, a layer of the foamed fixer having a thickness of approximately 130 μm was formed on the application roller. When the layer thickness of the foamed fixer was controlled with a gap of 250 μm between the blade and the application roller, a layer of the foamed fixer having a thickness of approximately 300 μm was formed on the application roller.

Ipsio Color CX8800 (manufactured by Ricoh) was employed as the printer. First, an unfixed toner color image was formed on a PPC sheet. Next, a fixing device as illustrated in FIG. 7 was used to apply the fixer with the roller, and 10 seconds later, the surface of the image was rubbed with a rag. The degree by which the toner had been fixed onto the PPC sheet was determined depending on whether the toner adhered to the rag.

When the layer thickness of the foamed fixer was made to be 130 μm with the gap of 100 μm between the blade and the application roller, it was found that toner did not adhere to the rag after rubbing the image 10 seconds after applying the fixer. Furthermore, substantially no dampness remained on the PPC sheet, and substantially no curls appeared in the PPC sheet. Moreover, substantially no toner was offset onto the application roller. Meanwhile, when the layer thickness of the foamed fixer was made to be 300 μm with the gap of 250 μm between the blade and the application roller, it was found that the toner became fluid, thus creating a considerably degraded fluid image.

According to one embodiment of the present invention, a fixing operation can be performed with excellent responsiveness with an extremely small amount of fixer, and without disturbing resin particles resting on a medium so that resin particles are not offset onto a fixer application unit.

Further, according to one embodiment of the present invention, a foamed fixer can be stably generated, thereby enhancing fixing reliability.

Further, according to one embodiment of the present invention, a foamed fixer can be easily generated without using a mechanical mechanism, so that a fixing device can be made compact and light-weight.

Further, according to one embodiment of the present invention, a fixing operation can be performed with excellent responsiveness without causing an offset of resin particles.

Further, according to one embodiment of the present invention, an image forming apparatus is provided in which resin particles such as toner particles are quickly fixed onto a medium such as paper after applying a fixer without disturbing the particles; the fixing operation can be performed by applying an extremely small amount of fixer such that dampness does not remain on the medium; a non-heat fixing method is employed so that power consumption is reduced; and the fixing responsiveness is excellent.

Further, according to one embodiment of the present invention, at least one layer of fine bubbles with uniform sizes is formed in the foamed fixer, thereby enhancing fixing reliability.

Further, according to one embodiment of the present invention, resin particles do not become excessively soft, so that the resin particles do not become adhesive after being fixed.

Further, according to one embodiment of the present invention, a highly-safe, environmentally-benign fixer can be formed.

Further, according to one embodiment of the present invention, the fixing operation can be performed without curling or creasing the medium.

The present invention is not limited to the specifically disclosed embodiment, and variations and modifications may be made without departing from the scope of the present invention.

The present application is based on Japanese Priority Patent Application No. 2006-038715, filed on Feb. 16, 2006, the entire contents of which are hereby incorporated by reference.

The invention claimed is:

1. A fixing device for fixing resin particles onto a medium by applying a fixer including a softening agent onto the resin particles resting on the medium, wherein the softening agent softens the resin particles by dissolving or causing swelling of at least part of resin included in the resin particles, the fixing device comprising:

a foamed fixer generating unit configured to generate a foamed fixer from the fixer;

a layer thickness controlling unit configured to control a layer thickness of the foamed fixer generated by the foamed fixer generating unit; and an applying unit configured to apply the foamed fixer whose layer thickness is controlled onto the resin particles resting on the medium.

2. The fixing device according to claim 1, wherein the foamed fixer generating unit is configured to generate the foamed fixer by applying a shear force to the fixer such that bubbles are created in the fixer.

3. The fixing device according to claim 1, wherein the foamed fixer generating unit is configured to generate the foamed fixer by putting in an airtight container the fixer and liquefied gas or compressed gas mixed together, and ejecting the fixer from the airtight container such that the gas expands and bubbles are created in the fixer.

4. The fixing device according to claim 3, wherein the foamed fixer generating unit includes an actuator and a nozzle through which contents of the airtight container are released to an atmosphere, wherein the airtight container contains the fixer including the softening agent for softening the resin particles in an airtight manner such that pressure inside the airtight container is higher than atmospheric pressure.

5. The fixing device according to claim 1, wherein the applying unit is a contact-type applying unit that comes in contact with the medium to apply the foamed fixer, and the layer thickness controlling unit controls the layer thickness of the foamed fixer according to contact force between the applying unit and the medium.

6. The fixing device according to claim 1, wherein the layer thickness controlling unit controls the layer thickness of the foamed fixer according to a layer thickness of the resin particles resting on the medium.

7. An image forming apparatus comprising:

an image forming unit configured to form an unfixed toner image on the medium with the resin particles by performing an electrostatic recording process, wherein the resin particles are toner particles including coloring material; and the fixing device according to claim 1 configured to fix the unfixed toner image onto the medium.

8. A fixer for fixing resin particles onto a medium, the fixer comprising:

a softening agent configured to soften the resin particles by dissolving or causing swelling of at least part of the resin particles;

a frothing agent; and a foam increasing agent.

9. The fixer according to claim 8, further comprising:

a diluent solvent configured to dilute the softening agent.

10. The fixer according to claim 8, wherein liquefied gas or compressed gas is dissolved or dispersed in the fixer.

11. The fixer according to claim 8, wherein the softening agent includes aliphatic ester.

12. The fixer according to claim 11, wherein the aliphatic ester includes saturated aliphatic ester.

13. The fixer according to claim 12, wherein the saturated aliphatic ester includes compounds indicated in a general formula $$R1COOR2$$

where R1 is an alkyl group having a carbon number of 11 or more and 14 or less, and R2 is an alkyl group having a carbon number of 1 or more and 6 or less.

14. The fixer according to claim 11, wherein the aliphatic ester includes aliphatic dicarboxylic acid ester.

15. The fixer according to claim 14, wherein the aliphatic dicarboxylic acid ester includes compounds indicated in a general formula $$R3(COOR4)_2$$

where R3 is an alkylene group having a carbon number of 3 or more and 8 or less, and R4 is an alkyl group having a carbon number of 2 or more and 5 or less.

16. The fixer according to claim 11, wherein the aliphatic ester includes aliphatic dicarboxylic acid dialkoxyalkyl.

17. The fixer according to claim 16, wherein the aliphatic dicarboxylic acid dialkoxyalkyl includes compounds indicated in the general formula $$R5(COOR6\text{-}O\text{—}R7)_2$$

where R5 is an alkylene group having a carbon number of 2 or more and 8 or less, R6 is an alkylene group having a carbon number of 2 or more and 4 or less, and R7 is an alkyl group having a carbon number of 1 or more and 4 or less.

18. The fixer according to claim 9, wherein the diluent solvent that dilutes the softening agent includes water and monohydric or polyhydric alcohol.

19. The fixer according to claim 9, wherein the diluent solvent that dilutes the softening agent includes an olefinic compound.

20. The fixer according to claim 9, wherein the diluent solvent that dilutes the softening agent includes dimethyl silicone.

* * * * *